US005471051A

United States Patent [19]

Niigaki et al.

[11] Patent Number: 5,471,051

[45] Date of Patent: Nov. 28, 1995

[54] PHOTOCATHODE CAPABLE OF DETECTING POSITION OF INCIDENT LIGHT IN ONE OR TWO DIMENSIONS, PHOTOTUBE, AND PHOTODETECTING APPARATUS CONTAINING SAME

[75] Inventors: Minoru Niigaki; Katsuyuki Kinoshita; Toru Hirohata; Tuneo Ihara; Masami Yamada; Norio Asakura; Yasuharu Negi; Tomoko Suzuki, all of Hamamatsu, Japan

[73] Assignee: Hamamatsu Photonics K.K., Hamamatsu, Japan

[21] Appl. No.: 251,928

[22] Filed: Jun. 1, 1994

[30] Foreign Application Priority Data

Jun. 2, 1993 [JP] Japan ..... 5-132216

[51] Int. Cl.[6] ..... H01J 40/14

[52] U.S. Cl. ..... 250/214 VT; 257/11; 257/448; 313/531; 313/542

[58] Field of Search ..... 250/214 VT; 257/10, 257/11, 443, 448, 459, 184; 313/527, 531, 542, 543, 544

[56] References Cited

U.S. PATENT DOCUMENTS

| | | | |
|---|---|---|---|
| 2,668,184 | 2/1954 | Taylor et al. | 136/89 |
| 3,859,521 | 1/1975 | Conners et al. | 250/211 J |
| 3,931,633 | 1/1976 | Shannon et al. . | |
| 4,060,823 | 11/1977 | Howorth et al. . | |
| 5,047,821 | 10/1991 | Costello et al. | 357/30 |
| 5,191,202 | 3/1993 | Kitamura et al. | 250/208.1 |
| 5,210,434 | 5/1993 | Ohmi et al. | 257/291 |
| 5,336,902 | 8/1994 | Nigaki et al. | 257/10 |
| 5,336,906 | 8/1994 | Ito et al. | 257/72 |

FOREIGN PATENT DOCUMENTS

| | | |
|---|---|---|
| 0259878 | 3/1988 | European Pat. Off. . |
| 60-020441 | 2/1985 | Japan . |
| 04269419 | 9/1992 | Japan . |
| 9114283 | 9/1991 | WIPO . |

OTHER PUBLICATIONS

Patent Abstracts of Japan, vol. 17, No. 61 (E-1316) 5 Feb. 1993 & JP-A-04 269 419 (Hamamatsu Photonics K.K.) 25 Sep. 1992 *abstract*.

*Primary Examiner*—Edward P. Westin
*Assistant Examiner*—Stephen Calogero
*Attorney, Agent, or Firm*—Cushman Darby & Cushman

[57] ABSTRACT

There is disclosed a photocathode comprising:

a photoelectric conversion layer for internally exciting photoelectrons in response to incident photons; a semiconductor layer having a photoelectron emission surface for emitting the photoelectrons generated and accelerated in the photoelectric conversion layer from the photoelectron emission surface; an upper surface electrode formed on the photoelectron emission surface of the semiconductor layer; and a lower surface electrode formed on the semiconductor layer so that the lower surface electrode is opposite to the upper surface electrode through the semiconductor layer, the upper surface electrode being divided so as to provide a plurality of pixel electrodes which are electrically insulated from each other, the plurality of pixel electrodes being respectively connected to a plurarity of bias application wires.

26 Claims, 18 Drawing Sheets

PHOTOCATHODE CAPABLE OF DETECTING POSITION OF INCIDENT LIGHT IN ONE OR TWO DIMENSIONS, PHOTOTUBE, AND PHOTODETECTING APPARATUS CONTAINING SAME

BACKGROUND OF THE INVENTION

1. Field of the Invention

The present invention relates to a photocathode, a phototube, and a photodetecting apparatus and, more particularly, to a photodetecting technique for obtaining one- or two-dimensional information, e.g., an incident position or an incident light image of weak light.

2. Related Background Art

To perform photodetection including detection of one- or two-dimensional position information of weak light, an apparatus constituted by an image intensifier combined with a solid-state image sensor is generally used. In this apparatus, photoelectrons are excited by photons which are incident from the input window of a housing on a photocathode. The photoelectrons emitted from the photocathode into a vacuum are focused and accelerated by an electron lens system. Thereafter, the photoelectrons are focused by a phosphor and converted into an optical signal again, thereby intensifying the light. Photoelectric conversion of this intensified optical signal is performed by the solid-state image sensor, such as a CCD, and position information is extracted as an electrical signal.

A photomultiplier having a position detecting function is also used for photodetection. In this apparatus, the anode of the photomultiplier is divided and multiplied to perform photodetection, thereby obtaining position information. In addition, another example of a photomultiplier having the position detecting function is described in Japanese Patent Laid-Open No. 60-20441. In this photomultiplier, a photocathode is formed on the inner wall of a faceplate. A mesh electrode is provided between the photocathode and a focusing electrode for forming an electric field which guides photoelectrons emitted from the photocathode to a first-stage dynode. This mesh electrode is arranged on only one side at a position away from the photocathode by a 1/10 distance between the photocathode and the focusing electrode. The mesh electrode forms a field distribution for gradually preventing the photoelectrons from reaching the first-stage dynode from one side to the other side. Of the photoelectrons emitted from the entire photoelectron emission surface of the photocathode, photoelectrons on one side are prevented from reaching the first-stage dynode when a bias voltage is applied to the mesh electrode. More specifically, the orbits of the photoelectrons are changed to multiply only photoelectrons emitted from a predetermined portion of the emission surface and output them as an electrical signal. On the basis of the output signal level and the bias voltage level applied to the mesh electrode, photodetection with position resolution is performed by an external determination apparatus. In this manner, only the photoelectrons which are excited by light incident on a specific position and whose orbits are not interrupted are detected to perform position detection.

In the conventional apparatus in which an image intensifier and a solid-state image sensor are combined, conversion of optical signal→electrical signal→optical signal→electrical signal cannot be substantially avoided. Therefore, a coupling loss or the like decreases the efficiency, resulting in poor performance.

In the multianode photomultiplier, crosstalk between the photocathode and the multiplier section, or between the multiplier section and the anode poses a problem, and the position resolution is not substantially improved.

In the photomultiplier having a mesh electrode, only some of photoelectrons emitted from the entire photoelectron emission surface of the photocathode are detected upon measurement to perform position detection. For this reason, a substantial problem on S/N ratio arises. As for the position resolution, the orbits of the photoelectrons are changed to perform position determination, the crosstalk is structurally increased. In addition, position determination is possible at only about two portions for one photomultiplier, and it is substantially difficult to realize a multi-element structure.

SUMMARY OF THE INVENTION

It is an object of the present invention to realize a photocathode having a position detecting function with minimum crosstalk, and a phototube and a photodetecting apparatus using this photocathode.

A photocathode according to the present invention includes a photoelectric conversion layer for internally exciting photoelectrons by incident photons, a semiconductor layer for emitting the photoelectrons generated and accelerated in the photoelectric conversion layer from a photoelectron emission surface, an upper surface electrode formed on the semiconductor layer of the photoelectron emission surface, and a lower surface electrode formed on the semiconductor layer so that said lower surface electrode is opposite to said upper surface electrode through the semiconductor layer the upper surface electrode is divided to form a plurality of pixel electrodes which are electrically insulated from each other, the plurality of pixel electrodes being respectively connected to a plurality of bias application wires.

A phototube of the present invention comprises a vacuum vessel, a photocathode disposed in the vacuum vessel, and an anode, disposed in the vacuum vessel, for receiving photoelectrons emitted from the photocathode, wherein the photocathode includes a photoelectric conversion layer for internally exciting photoelectrons by incident photons and has a semiconductor layer for emitting the photoelectrons generated and accelerated in the photoelectric conversion layer from a photoelectron emission surface, an upper surface electrode formed on the photoelectron emission surface, and a lower surface electrode formed on the semiconductor layer opposing the photoelectron emission surface to oppose the upper surface electrode, the upper surface electrode being divided to form a plurality of pixel electrodes which are electrically insulated from each other, and the plurality of pixel electrodes being connected to a plurality of bias application wires for individually applying a bias potential positive with respect to the lower surface electrode, the vacuum vessel incorporates switching control means having a plurality of switching elements for individually connecting/disconnecting the plurality of bias application wires with the plurality of pixel electrodes to individually switch bias application, a switching circuit for individually turning on/off the plurality of switching elements, and a plurality of switching wires for individually connecting a plurality of output terminals of the switching circuit to control terminals of the plurality of switching elements, and of a plurality of stem pins extending outside from the vacuum vessel, at least one is connected to the lower surface electrode, at least one is connected to the bias application wire, at least two are connected to input terminals of the switching circuit, and at least one is connected to the anode.

A photodetector according to the present invention comprises a phototube having a photocathode and an anode in a vacuum vessel, a power supply for applying a potential to the photocathode and the anode, timing control means, and memory means. The photocathode includes a photoelectric conversion layer for internally exciting photoelectrons by incident photons and has a semiconductor layer for emitting the photoelectrons generated and accelerated in the photoelectric conversion layer from a photoelectron emission surface, an upper surface electrode formed on the semiconductor layer of the photoelectron emission surface, and a lower surface electrode formed on the semiconductor layer opposing the photoelectron emission surface to oppose the upper surface electrode. The upper surface electrode is divided to form a plurality of pixel electrodes which are electrically insulated from each other, and the plurality of pixel electrodes are connected to a plurality of bias application wires for individually applying a bias potential positive with respect to the lower surface electrode. A plurality of switching elements for individually connecting/disconnecting the plurality of bias application wires with the plurality of pixel electrodes to individually switch bias application, a switching circuit for individually turning on/off the plurality of switching elements, and a plurality of switching wires for individually connecting a plurality of output terminals of the switching circuit to control terminals of the plurality of switching elements are provided in the vacuum vessel. The timing control means continuously applies a timing pulse to the switching circuit upon reception of a start signal, and the switching circuit sequentially switches ON/OFF states of the plurality of switching elements in response to the timing pulse, and the memory means starts a storage operation upon reception of the start signal and stores an output from the anode in correspondence with a position of the pixel electrode which is sequentially set in a photoelectron emission state on the basis of the timing pulse.

According to the photocathode of the present invention, since the upper surface electrode is divided to form the plurality of pixel electrodes, and a bias potential is individually applied to these pixel electrodes, only pixels to which the bias potentials are applied can emit the internally generated photoelectrons. For this reason, when the pixel electrodes are arranged in a one-dimensional array, one-dimensional position resolution can be realized, and when the pixel electrodes are arranged in a two-dimensional matrix, two-dimensional position resolution can be realized.

According to the phototube of the present invention, since the above-described photocathode is provided in the vacuum vessel, and at the same time, the switching control means for switching bias application to the plurality of pixel electrodes is provided, a phototube having one- or two-dimensional position resolution can be realized.

The photodetector of the present invention comprises the timing control means and the memory means in addition to the above-described phototube and the power supply. This timing control means can store the one- or two-dimensional image of weak light in the memory means because the memory means stores the output from the anode in correspondence with position information of a pixel electrode in the phototube, which is set in the photoelectron emission state.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

FIG. 1B is a longitudinal sectional view of the phototube taken along line $X_1$–$X_1$ of the plan view;

DETAILED DESCRIPTION OF THE PREFERRED EMBODIMENTS

Figure 1A:
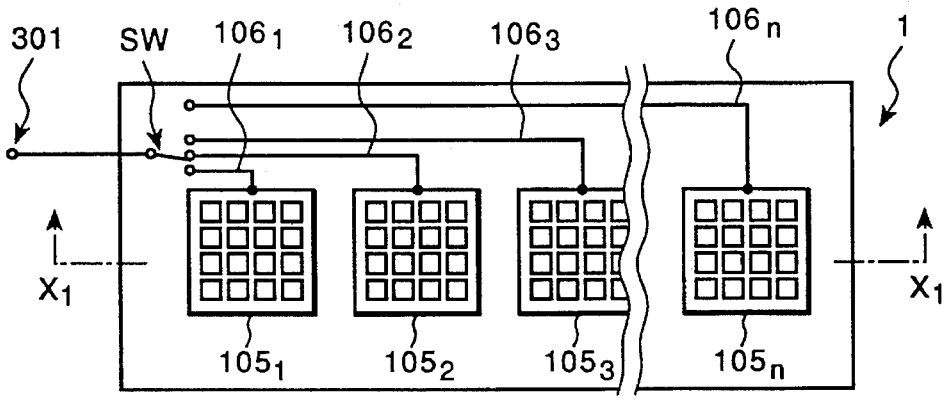
FIGS. 1A and 1B are views showing a photocathode and a phototube having the photocathode, in which the FIG. 1A is a plan view of the photocathode.
Figure 1B:
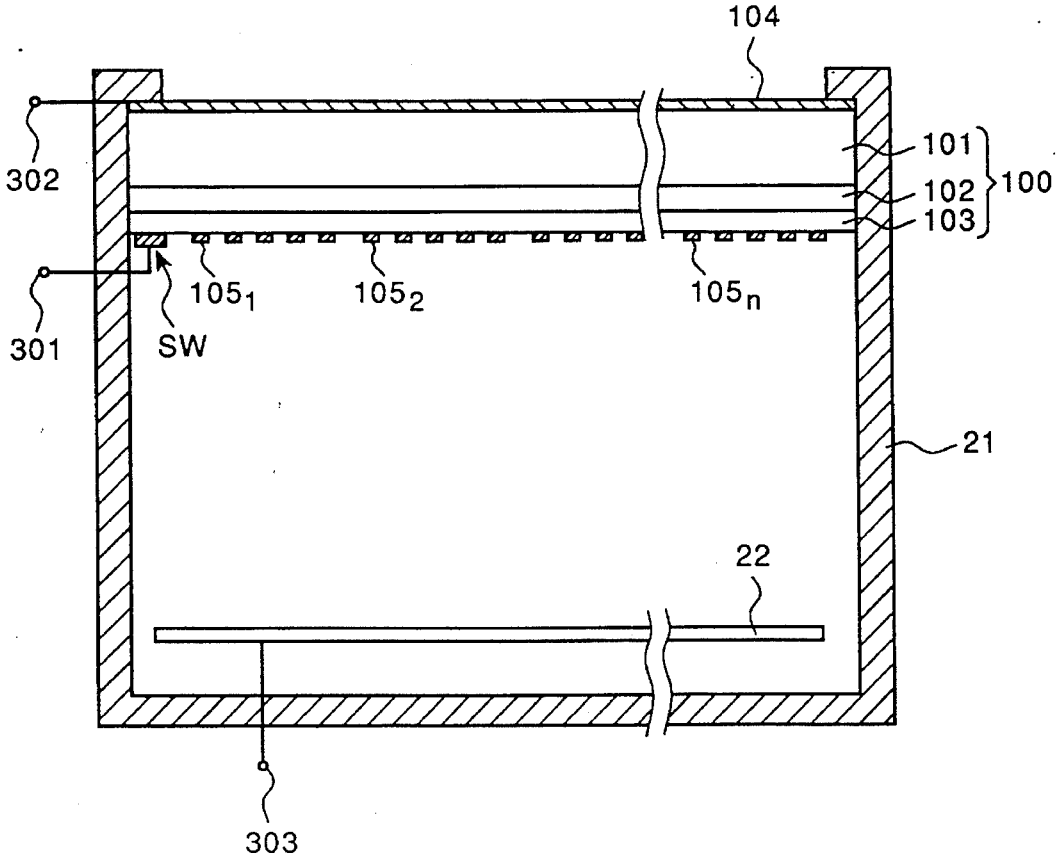

As shown in FIG. 1, a semiconductor layer 100 serving as the main body of a photocathode 1 is constituted by an InGaAs light absorption layer 102 formed on an InP substrate 101, and an InP contact layer 103 formed on the InGaAs light absorption layer 102. An ohmic electrode 104 consisting of, e.g., Au (gold) is formed as a lower surface electrode on the lower surface of the InP substrate 101. A Shottky electrode 105 consisting of, e.g., Al (aluminum) is formed as an upper surface electrode on the upper surface of the InP contact layer 103. The ohmic electrode 104 is formed to be thin or have a large number of openings to transmit incident light. The Shottky electrode 105 is divided to constitute pixel electrodes $\mathbf{105}_1$, $\mathbf{105}_2$, . . . , $\mathbf{105}_n$, all of which form a one-dimensional array. Each pixel electrode is patterned in a mesh, and photoelectrons can pass through these openings. On the upper surface of the InP contact layer 103, particularly on the opening portions of the mesh-like pixel electrode, Cs (cesium) or the like is thinly coated to decrease the work function on the upper surface, so that the photoelectrons can be easily emitted from the semiconductor layer 100 into a vacuum.

As shown in FIG. 1, this photocathode 1 is mounted in a vacuum vessel 21, and an anode 22 is arranged at a position opposing the photocathode 1. Bias application wires $\mathbf{106}_1$, $\mathbf{106}_2$, . . . , $\mathbf{106}_n$ are connected to the pixel electrodes $\mathbf{105}_1$, $\mathbf{105}_2$, . . . , $\mathbf{105}_n$, respectively, and connected to a power supply terminal 301 through a switch SW. On the other hand, the ohmic electrode 104 is connected to a power supply terminal 302. The terminal 301 has a high potential positive with respect to the terminal 302. For this reason, only the pixel electrodes $\mathbf{105}_1$ to $\mathbf{105}_n$ to which a bias voltage is applied from the terminal 301 by the switch SW have a high potential positive with respect to the ohmic electrode 104, and photoelectrons can be emitted from the openings of the pixel electrodes or part of the photoelectron emission surface near those openings. The photoelectrons emitted into the vacuum move in the direction of the anode 22. This is because the anode 22 is biased at a higher positive potential through a power supply terminal 303.

Figure 2:
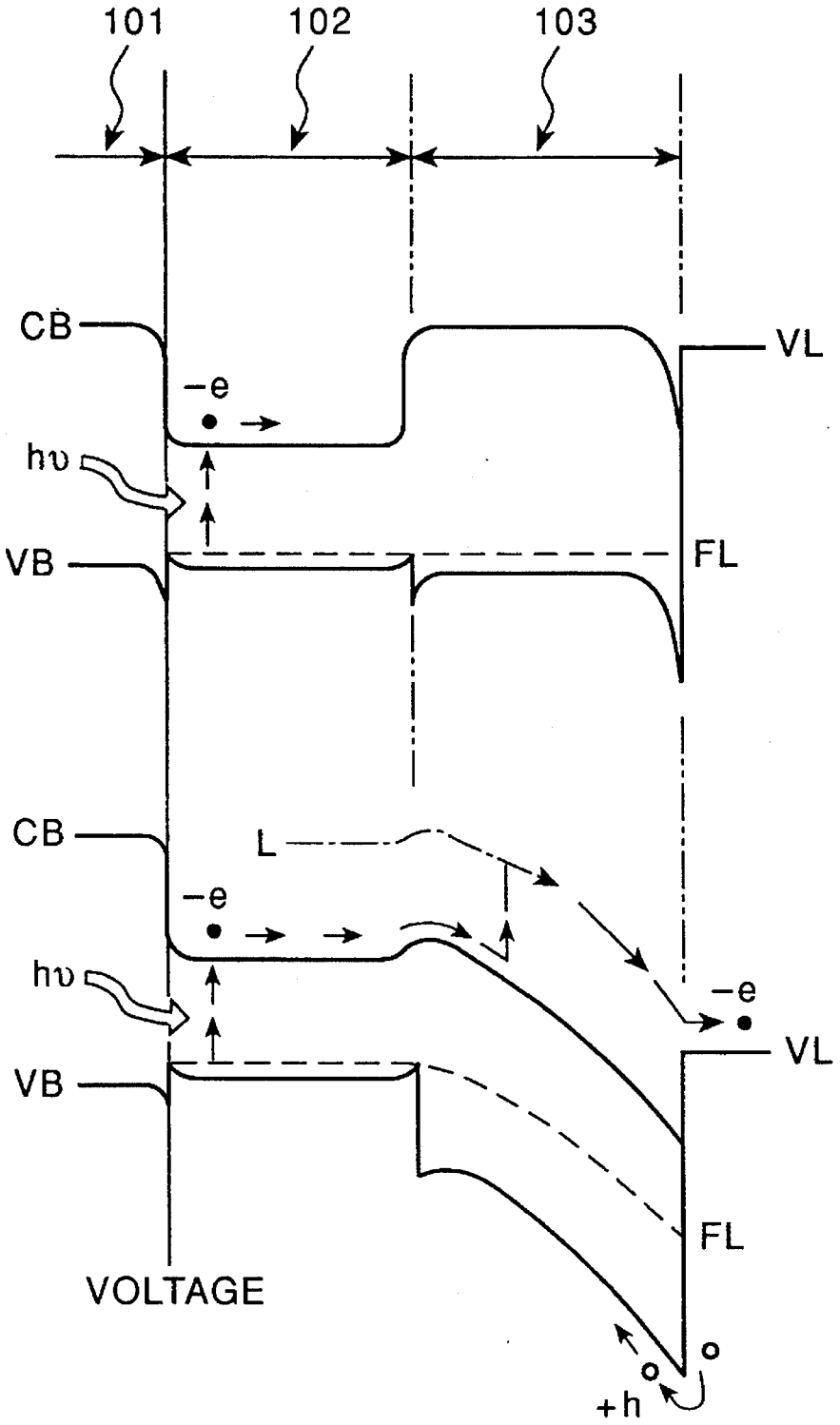
FIG. 2 is a view showing the energy band structure of the photocathode in FIGS. 1A and 1B, in which the upper side is a view when no bias voltage is applied, and the lower side is a view when a bias voltage is applied.

As shown in FIG. 2, when light (hv) to be detected is incident through the ohmic electrode 104, photoelectric conversion is performed in the InGaAs light absorption layer 102 having a narrow band gap to generate photoelectrons (−e) . At this time, if a bias voltage is applied between the ohmic electrode 104 and the Schottky electrode 105, the photoelectrons are accelerated in the semiconductor layer 100 toward the photoelectron emission surface to obtain a high energy, and emitted into the vacuum (level VL). Therefore, when the ON/OFF state of a bias applied to the pixel electrodes $\mathbf{105}_1$ to $\mathbf{105}_n$ formed by dividing the Schottky electrode 105 is individually switched by the switch SW, only the pixel electrodes set in the ON state by the switch SW can emit the photoelectrons generated in the InGaAs light absorption layer 102 from the photoelectron emission surface outside the semiconductor layer 100, i.e., into the vacuum.

Figure 3:
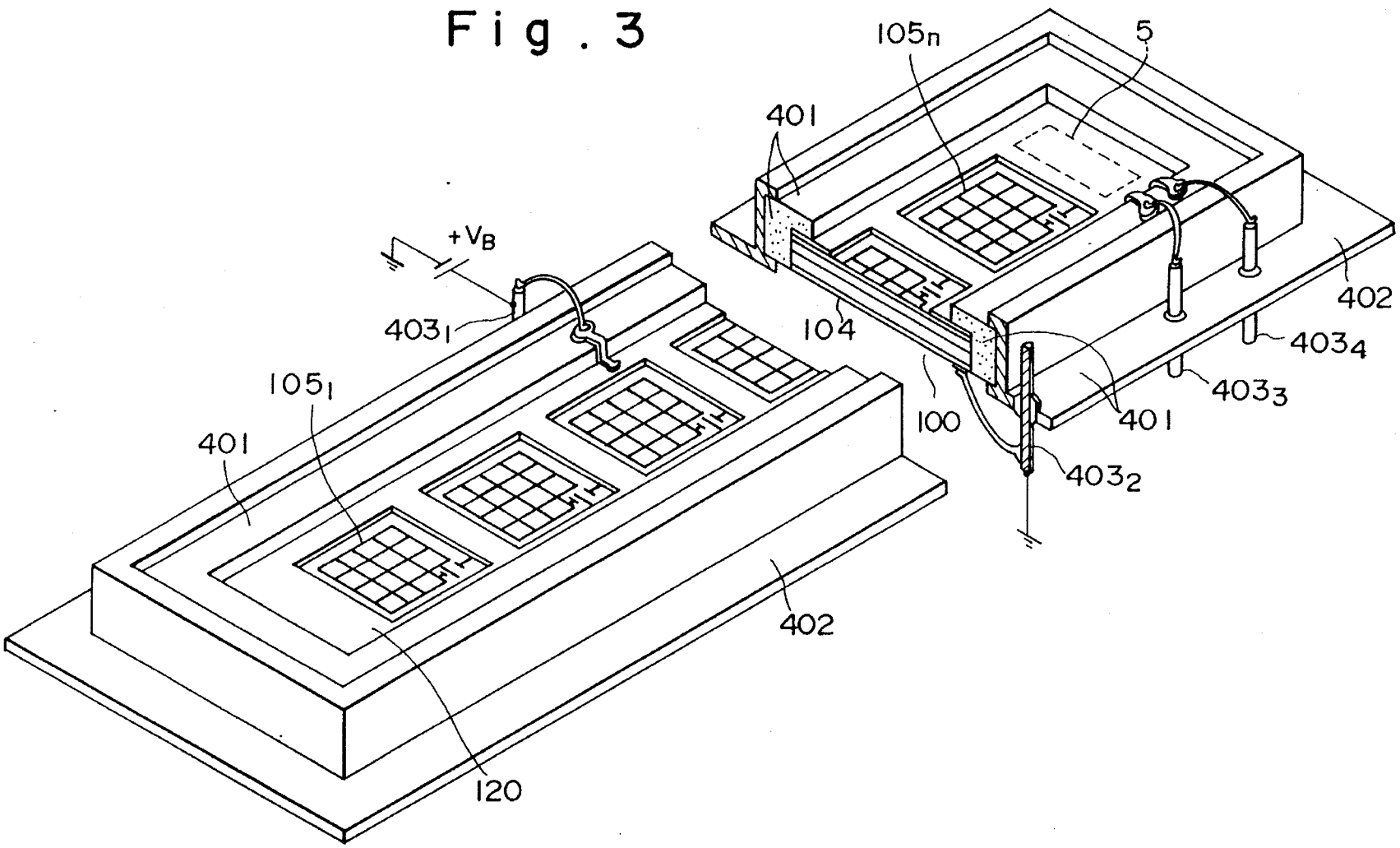
FIG. 3 is a perspective view showing the assembled body of the photocathode according to the embodiment in FIGS. 1A and 1B.

In the photocathode in FIG. 3, the pixel electrodes are arranged in a one-dimensional array and fixed to a holder. The long semiconductor layer 100 is fixed to a ceramic holder 401 fixed to a metal mold 402 of molybdenum. The semiconductor layer 100 is insulated from the metal mold 402. Terminal pins $\mathbf{403}_1$ to $\mathbf{403}_4$ are fixed to the metal mold 402 through insulating members. The pin $\mathbf{403}_1$ is connected to a positive bias power supply $+V_B$ and a bias application line (not shown) on the semiconductor layer 100. The pin $\mathbf{403}_2$ is grounded and the ohmic electrode 104 on the semiconductor layer 100. The pins $\mathbf{403}_3$ and $\mathbf{403}_4$ are connected to input terminals of a shift register 5 on the semiconductor layer 100. The shift register 5 serves as a switching control means for sequentially applying a bias voltage to the pixel electrodes $\mathbf{105}_1$ to $\mathbf{105}_n$. A start pulse SP and a clock pulse CLK (to be described later) are input to the shift register 5 through the terminal pins $\mathbf{403}_3$ and $\mathbf{403}_4$. The upper surface of the semiconductor layer 100, except for the photoelectron emission surface, is coated by an insulating film 120 of, e.g., $SiO_2$.

Figure 4:
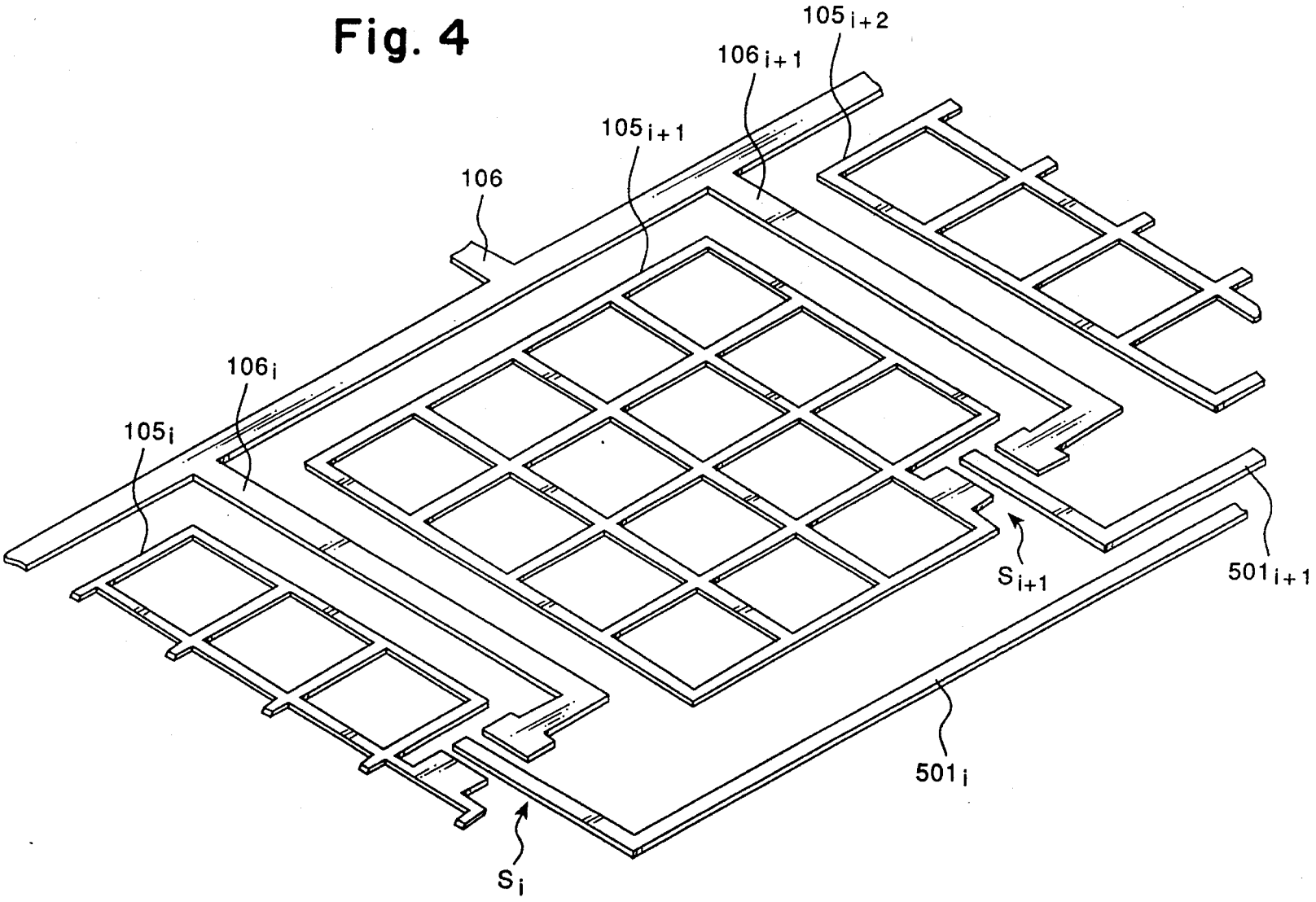
FIG. 4 is a perspective view showing an example of the pattern of a pixel electrode according to the embodiment in FIGS. 1A and 1B.

FIG. 4 is a perspective view showing the (i−1)th, ith, and (i+1)th pixel electrodes $\mathbf{105}_1$ to $\mathbf{105}_n$ in FIG. 3. More specifically, a pixel electrode $\mathbf{105}_i$ is patterned in a mesh to have 15 openings and has a switching element $S_i$ of a field effect transistor (FET) at a corner portion. The gate electrode of the FET is connected to the ith output terminal of the shift register 5 by an Al wire $\mathbf{501}_i$. Therefore, when a pulse is input from the shift register 5 through the Al wiring $\mathbf{501}_i$, the ith switching element $S_i$ is turned on, and a bias voltage $+V_B$ is applied to the pixel electrode $\mathbf{105}_i$ from the bias application wire $\mathbf{106}_1$. This operation is also performed for the 1st to (i−1)th, and (i+1)th to nth pixel electrodes.

Figure 5:
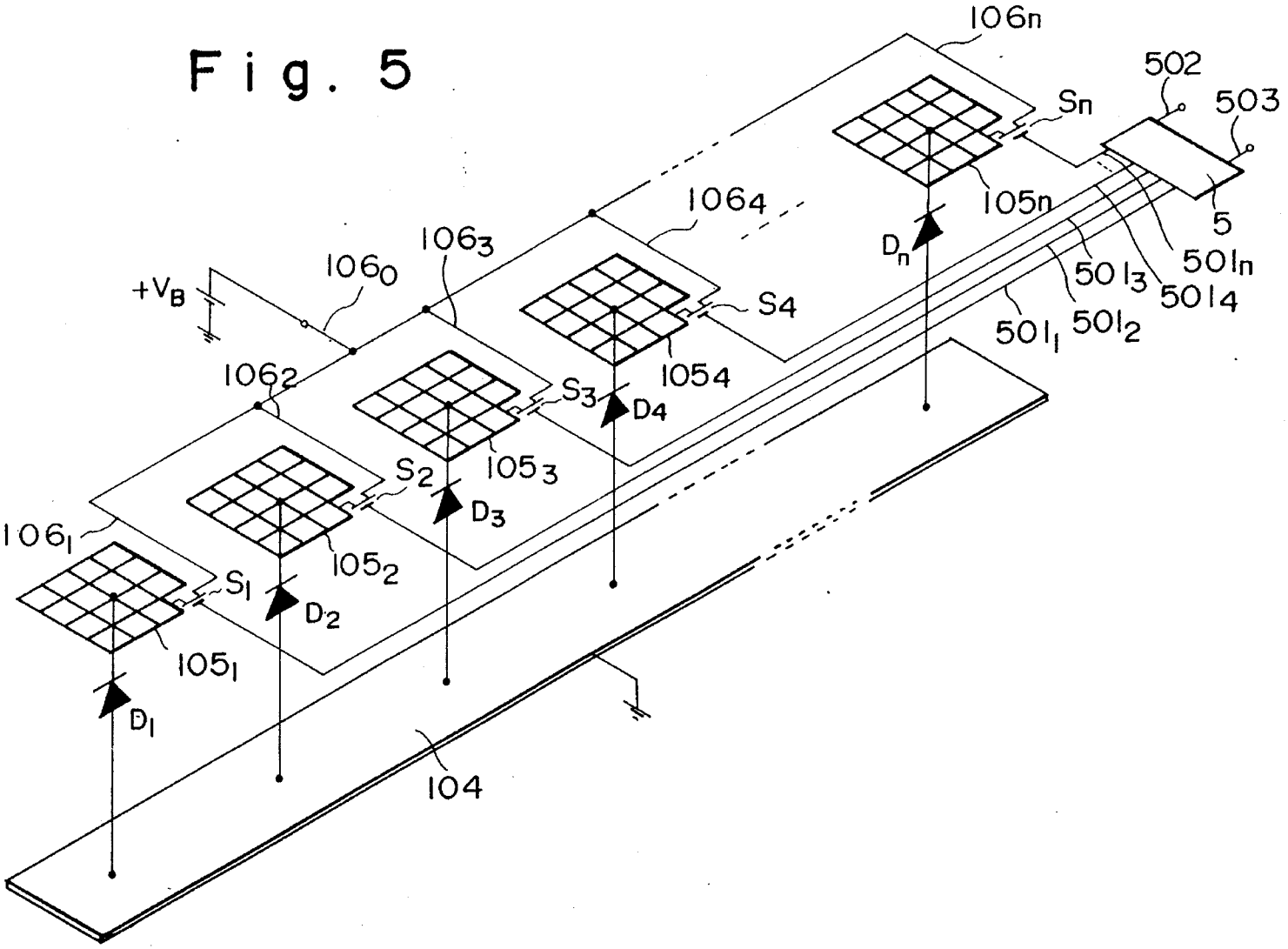
FIG. 5 is a perspective view showing an equivalent circuit of the photocathode according to the embodiment in FIGS. 1A and 1B.

FIG. 5 is a view three-dimensionally showing an equivalent circuit. As shown in FIG. 5, diodes $D_1$ to $D_n$ using the ohmic electrode 104 as a cathode are equivalently formed between the ohmic electrode 104 and the pixel electrodes $\mathbf{105}_1$ to $\mathbf{105}_n$, respectively. When switches $S_1$ to $S_n$ are turned on in accordance with outputs from the shift register 5, the diodes $D_1$ to $D_n$ of the pixel electrodes are individually reverse-biased. At this time, the photoelectrons are accelerated toward the pixel electrodes 105 by the electric field formed in the semiconductor layer 100 in the reverse-biased state to obtain a high energy, and emitted from the semiconductor layer 100, as shown in FIG. 2. Note that the clock pulse CLK is input to an input terminal 502 of the shift register 5, and the start pulse SP is input to a terminal 503.

Figure 6:
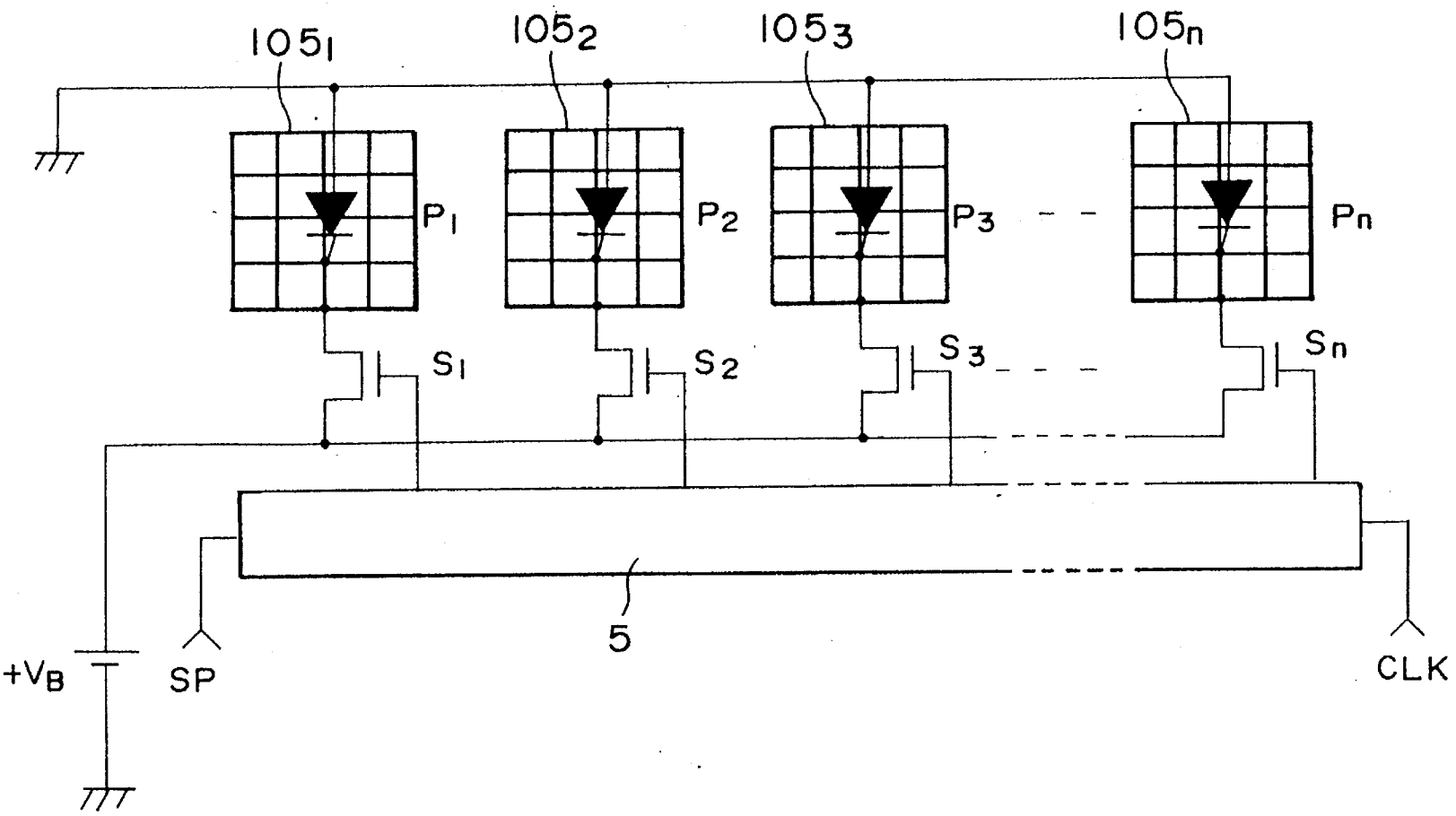
FIG. 6 is a view two-dimensionally showing the equivalent circuit of the photocathode according to the embodiment in FIGS. 1A and 1B.
Figure 7:
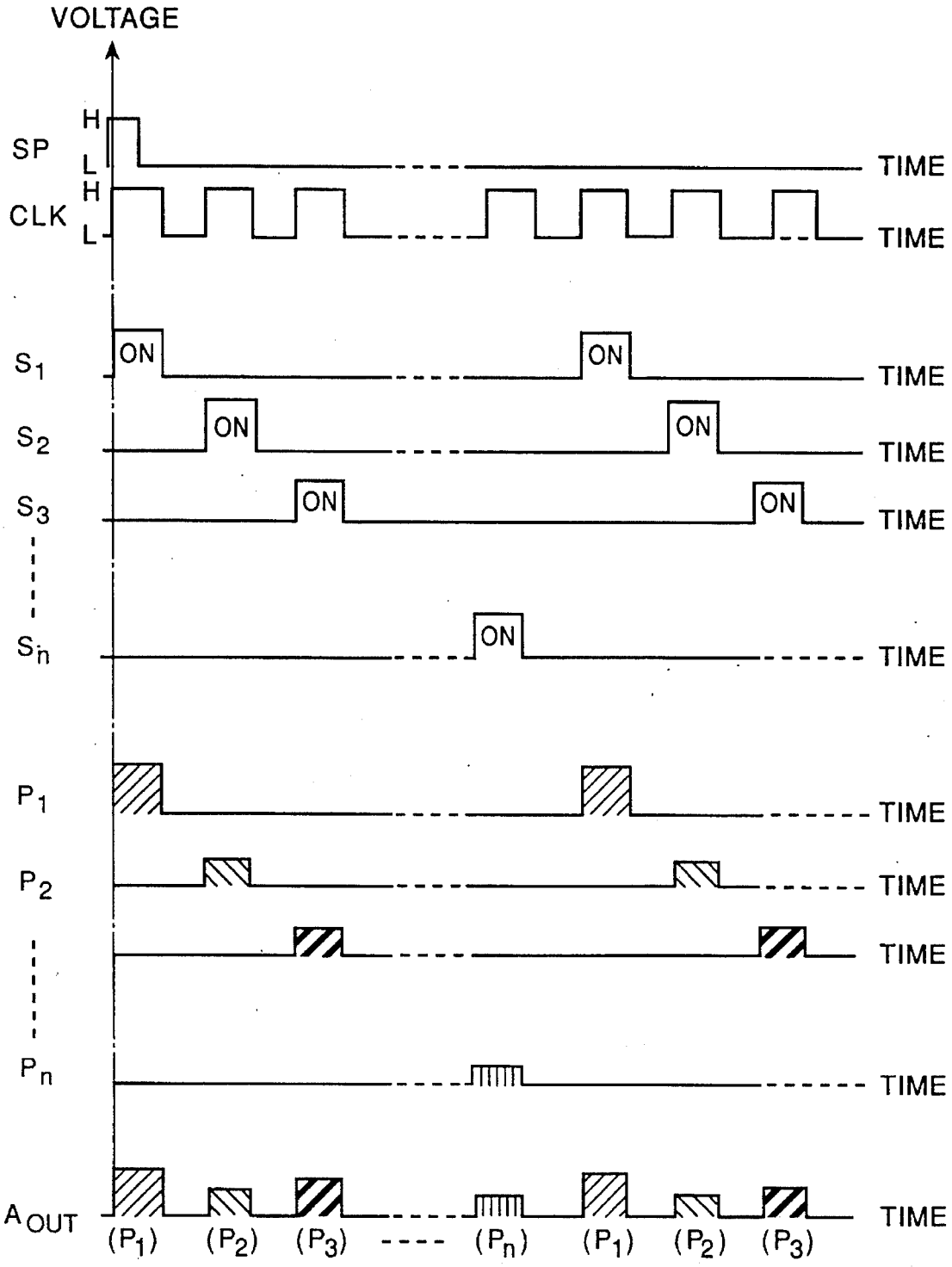
FIG. 7 is a timing chart showing an operation of the embodiment in FIGS. 1A and 1B.

The operation at this time will be described with reference to FIGS. 6 and 7. Reference symbols $P_1$ to $P_n$ denote photodetection outputs in the pixels corresponding to the pixel electrodes $\mathbf{105}_1$ to $\mathbf{105}_n$, respectively. The outputs $P_1$ to $P_n$ are extracted as an output $A_{OUT}$ from the anode 22 in the arrangement shown in FIG. 1. As shown in FIG. 7, the start pulse SP is applied to start the shift register 5. When the pulse SP is applied, the shift register 5 outputs a pulse from the output terminals $\mathbf{501}_1$ to $\mathbf{501}_n$ in response to the clock pulse CLK. With this operation, the switching elements $S_1$ to $S_n$ comprising the FETs are sequentially turned on to sequentially apply the bias $+V_B$ to the pixel electrodes $\mathbf{105}_1$ to $\mathbf{105}_n$. This operation sequentially allows photoelectron emission from the pixels, and the outputs $P_1$ to $P_n$ are sequentially extracted outside as the anode output $A_{OUT}$.

Figure 8:
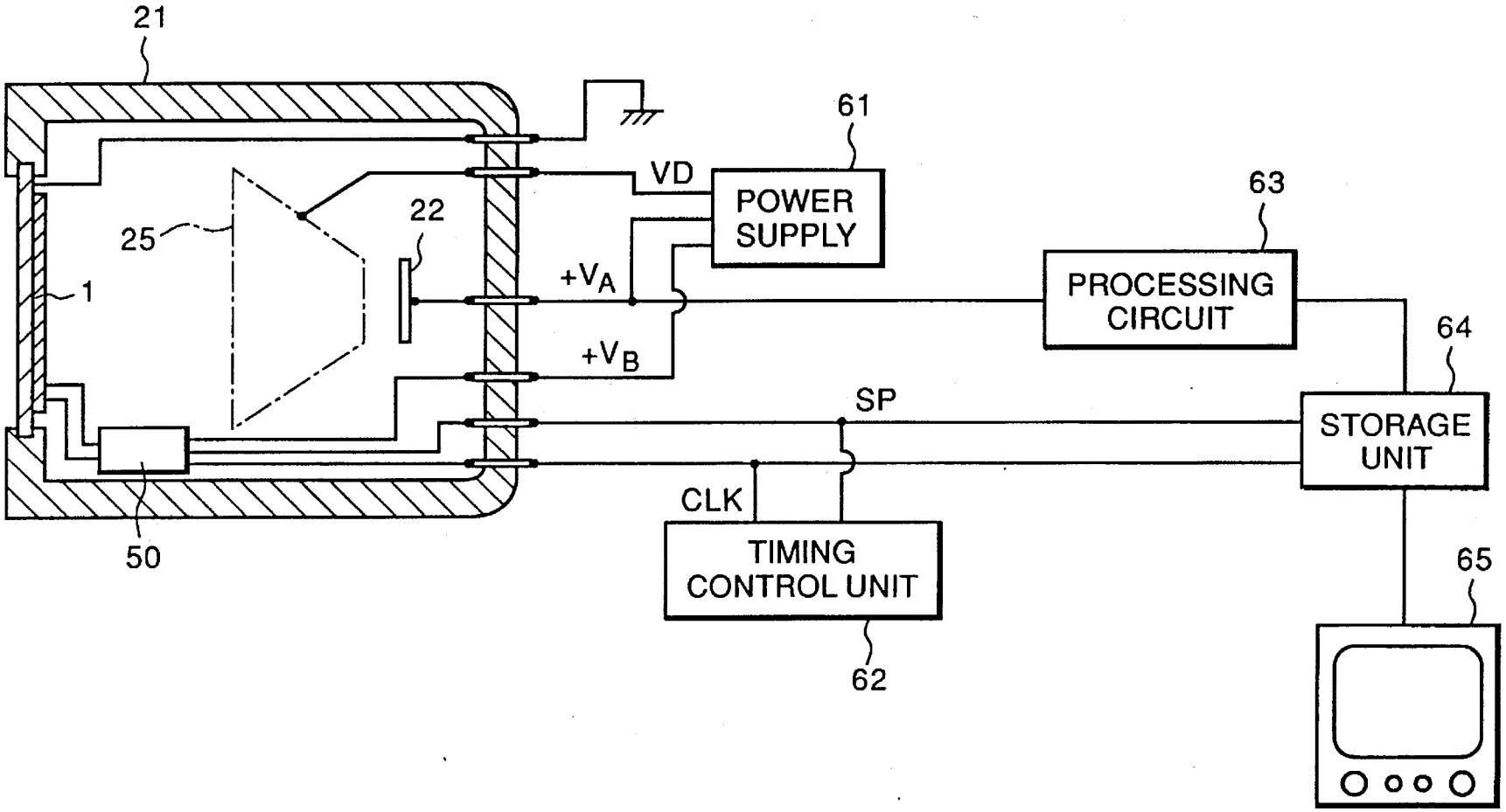
FIG. 8 is a view showing a photodetecting apparatus using the photocathode according to the embodiment in FIGS. 1A and 1B.

A photodetecting apparatus to which the photocathode according to the above embodiment is applied will be described with reference to FIG. 8. As shown in FIG. 8, the transmission photocathode 1 is mounted in the input window of the vacuum vessel 21. A switching control unit 50, the anode 22, and a dynode 25 for secondary-electron multiplying photoelectrons are disposed in the vacuum vessel 21. A power supply 61 applies, through stem pins extending through the vacuum vessel 21, an anode potential $+V_A$ to the anode 22, a dynode potential $V_D$ to the dynode 25, and the bias potential $+V_B$ to the switching control unit 50. A timing control unit 62 outputs the start pulse SP in accordance with designation of an operator or the like and continuously outputs the clock pulse CLK having a predetermined period. A signal processing circuit 63 amplifies the anode output $A_{OUT}$, performs a threshold processing to remove noise or analog/digital conversion, and supplies output signals to a storage unit 64 having a controller such as a microprocessor. A display unit 65 is connected to the storage unit 64.

In this arrangement, when the start pulse SP is output from the timing control unit 62, the switching control unit 50 and the storage unit 64 are started and operated in response to the clock pulse CLK. More specifically, every time the clock pulse CLK is input, the switching control unit 50 sequentially outputs a pulse from the output terminal corresponding to each pixel electrode, thereby allowing each pixel to emit photoelectrons. The photoelectrons emitted in this manner are multiplied by the dynode 25 and received by the storage unit 64 through the signal processing circuit 63.

At this time, the clock pulse CLK from the timing control unit 62 is also applied to the storage unit 64. For this reason, the controller of the storage unit 64 stores, in accordance with count value of the clock pulse CLK, the anode output $A_{OUT}$ in correspondence with the position of the pixel which is set in the photoelectron emission state. For example, the storage unit 64 stores the value of the anode output $A_{OUT}$ (a digital-converted value) as data using the count value of the clock pulse CLK as an address. This processing can be understood from the timing chart in FIG. 7. When the sequential ON/OFF switching operation for each pixel electrode is repeated a plurality of times, and the anode output $A_{OUT}$ is added for each pixel and stored in a storage area of the storage unit 64, which corresponds to the position of the pixel, data of the detected light can be obtained as image data. This image data is displayed on the display unit 65 having a CRT or the like.

Figure 9A:
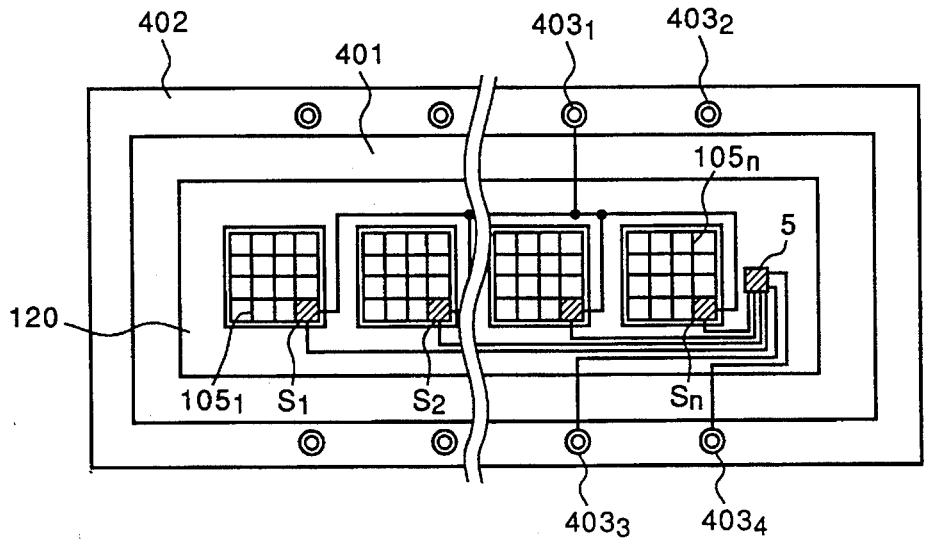
FIGS. 9A–9C are views of another example of the assembled body of the photocathode according to the embodiment in FIGS. 1A and 1B, including a plan view FIG. 9A, a side view FIG. 9B, and a bottom plan view FIG. 9C.
Figure 9B:
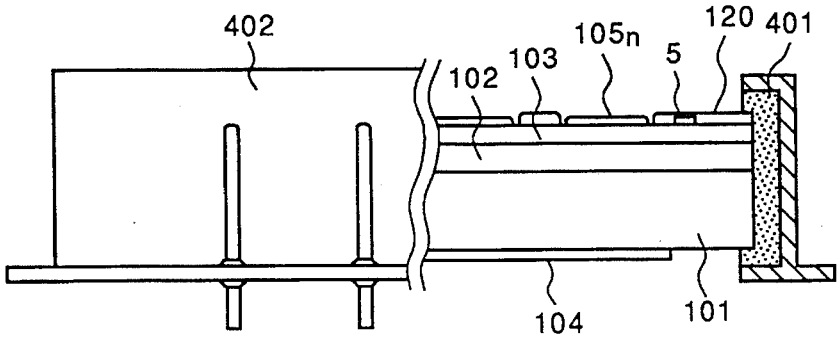
Figure 9C:
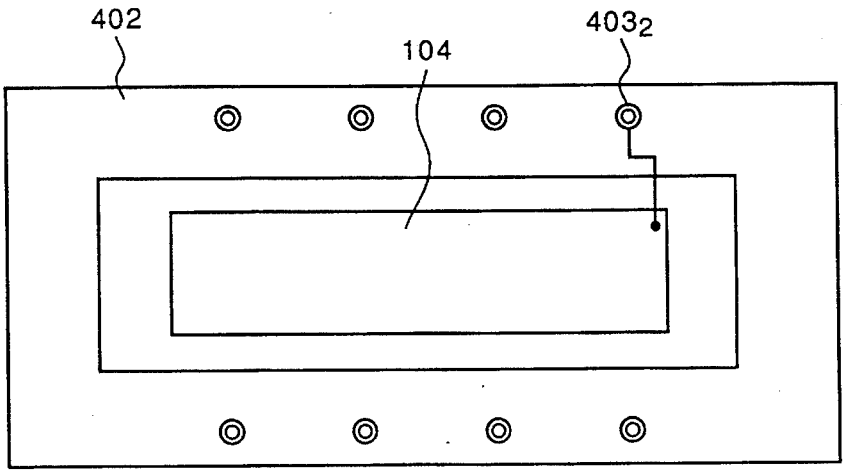

FIG. 9 is a view showing another example of the photocathode according to the embodiment in FIG. 1, in which the upper side is a plan view, the central portion is a partially cutaway side view, and the lower side is a bottom plan view. The InGaAsP light absorption layer 102 and the InP contact layer 103 are epitaxially grown on the InP substrate 101. The Au ohmic electrode 104 is formed on the lower surface of the InP substrate 101. A plurality of Al Schottky electrodes 105 are formed in a pattern on the InP contact layer 103 to have a Schottky junction with the InP contact layer 103. The semiconductor layer 100 comprising the substrate 101, the light absorption layer 102, and the contact layer 103 may have a heterojunction structure consisting of GaAs, AlAs, or a mixed crystal thereof, or may have a heterojunction structure consisting of Ge (germanium), Si (silicon), or a mixed crystal thereof. The Schottky electrode 105 can be formed of, e.g., Al, Au, Ag (silver), W (tungsten), Ti (titanium), or an alloy thereof.

Figure 10A:
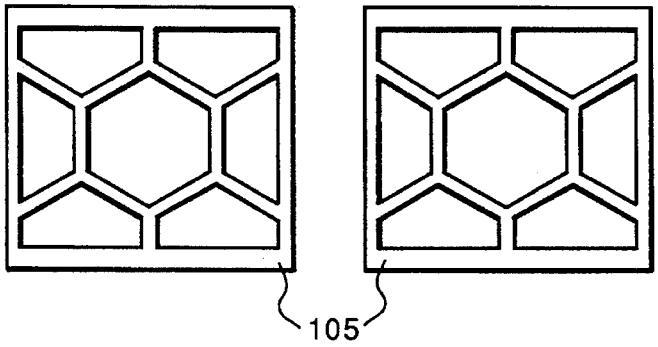
FIGS. 10A–10C are plan views showing other examples of the pixel electrode according to the embodiment in FIGS. 1A and 1B.
Figure 10B:
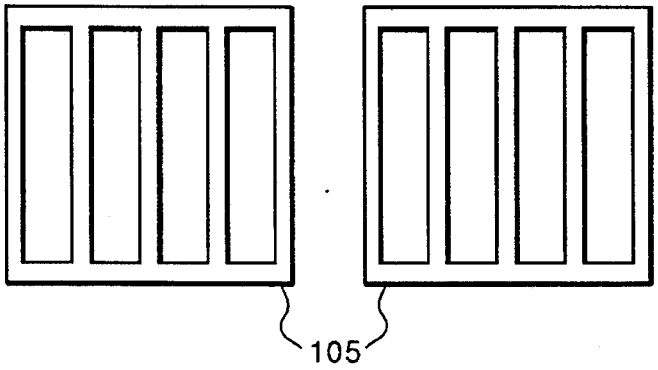
Figure 10C:
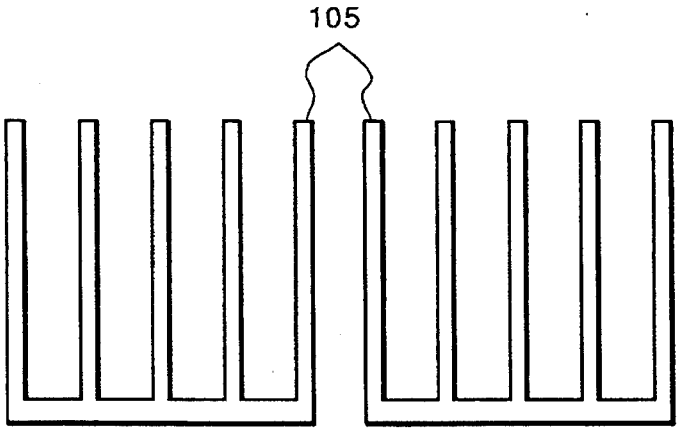

The Schottky electrode 105 may be a mesh-like electrode comprising linear members crossing perpendicular to each other, as shown in FIG. 9, or may have a pattern as shown in FIGS. 10A–10C. Referring to FIG. 10A, the drawing shows a pattern of a mesh-like electrode having a hexagonal opening. FIG. 10B shows a stripe pattern of a grid-like electrode comprising parallel members. The view on the shows a comb-like pattern. In all the patterns, an interval between the openings through which the photoelectrons pass is set to about 10 μm or less. The light may be incident through the lower surface, i.e., the ohmic electrode 104. However, the light may also be incident through the upper surface, i.e., the openings of the Schottky electrode 105. When the light is to be incident from the lower surface, the ohmic electrode 104 is formed of a material having light transmission properties, a sufficiently thin metal film for transmitting the light, or a metal film having a large number of openings for transmitting the light.

Referring to FIG. 9, the switches $S_1$ to $S_n$ of the FETs are formed near the corresponding pixel electrodes $\mathbf{105}_1$ to $\mathbf{105}_n$, respectively. The ON/OFF operation of a bias voltage to the electrodes $\mathbf{105}_1$ to $\mathbf{105}_n$ is performed by the switching function of the FETs. A thin Cs (cesium) film is formed on the photoelectron emission surface to decrease the work function. As the coating material, an alkali metal, an alkali metal compound, or an oxide or fluoride thereof is used. K (potassium), Na (sodium), and Rb (rubidium) are included in alkali metals in addition to Cs. The substrate 101 is fixed by the ceramic holder 401. Except for the portion where the Al Schottky electrode 105 is formed, the upper surface of the substrate 101 is coated by the insulating film 120 consisting of $SiO_2$ or SiN.

In the example shown in FIG. 9, the shift register 5 comprising a transistor is formed on the semiconductor layer 100. The gates of the FETs $S_1$ to $S_n$ are connected to n output terminals of the shift register 5, respectively. The shift register 5 generates a scanning pulse in accordance with the externally applied start pulse SP and clock pulse CLK to sequentially turn the FETs $S_1$ to $S_n$ on, thereby addressing the Al Schottky electrodes $\mathbf{105}_1$ to $\mathbf{105}_n$. Note that the terminals $\mathbf{403}_1$ and $\mathbf{403}_4$ are used to connect the circuits on the substrate 100 to the external circuits. The terminals $\mathbf{403}_3$ and $\mathbf{403}_4$ are terminals for inputting a signal to the shift register 5, and the terminal $\mathbf{403}_1$ is a terminal for externally applying the bias voltage $+V_B$ to the Schottky diodes $D_1$ to $D_n$ through the FETs $S_1$ to $S_n$.

Figure 11A:
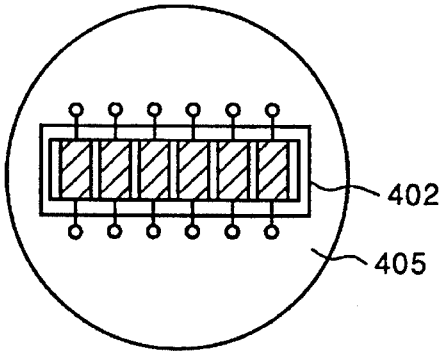
FIGS. 11A and 11B are views showing a head-on type photomultiplier using the photocathode according to the embodiment.
Figure 11B:
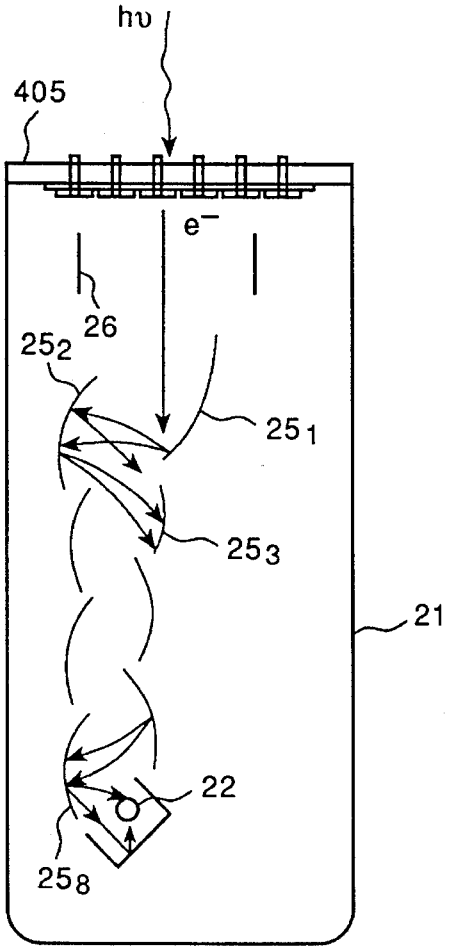

FIG. 11 is a view showing a head-on type photomultiplier to which the photocathode according to the embodiment is applied, in which the upper side is a schematic view of a faceplate when viewed from the inside, and the lower side is a sectional view of a housing 21 in an axial direction. Note that n=6 for illustrative convenience. A ceramic holder 402 for fixing a semiconductor substrate serving as the photocathode is fixed to a fixing fitment 405 of molybdenum by spot welding. An electrode terminal (not shown is connected on the outer side of the faceplate. A focusing electrode 26 and eight stages of dynodes $\mathbf{25}_1$ to $\mathbf{25}_8$ are arranged in the vacuum vessel, i.e., the housing 21. An anode 22 is provided in front of a reflection dynode $\mathbf{25}_9$ at the ninth stage. In this photomultiplier, six sets of terminal pins (not shown) are provided in correspondence with six pixels, respectively, and the pixels for emitting the photoelectrons are switched in accordance with outputs from an external control circuit.

Figure 12A:
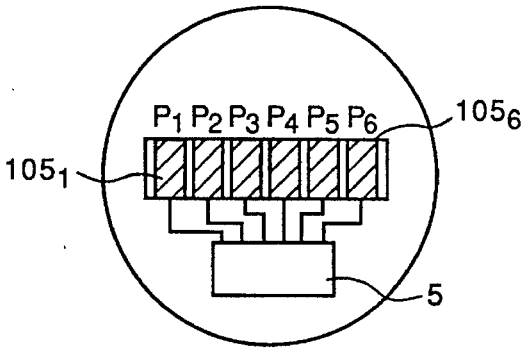
FIGS. 12A and 12B are views showing a head-on type photomultiplier using the photocathode according to the embodiment.
Figure 12B:
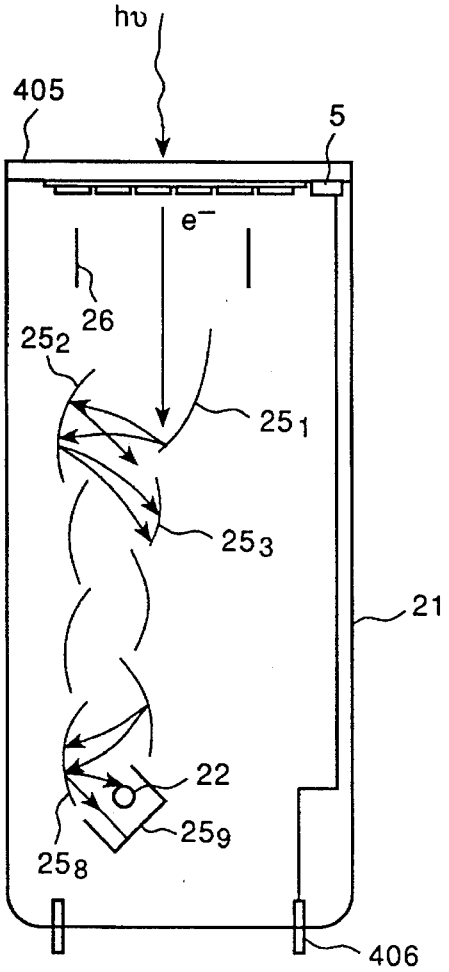

In a photomultiplier shown in FIG. 12, a control circuit is realized by the shift register 5 provided on the faceplate 405. An input operation of a start pulse SP and a clock pulse CLK to this shift register 5 is realized by a stem pin 406.

Figure 13:
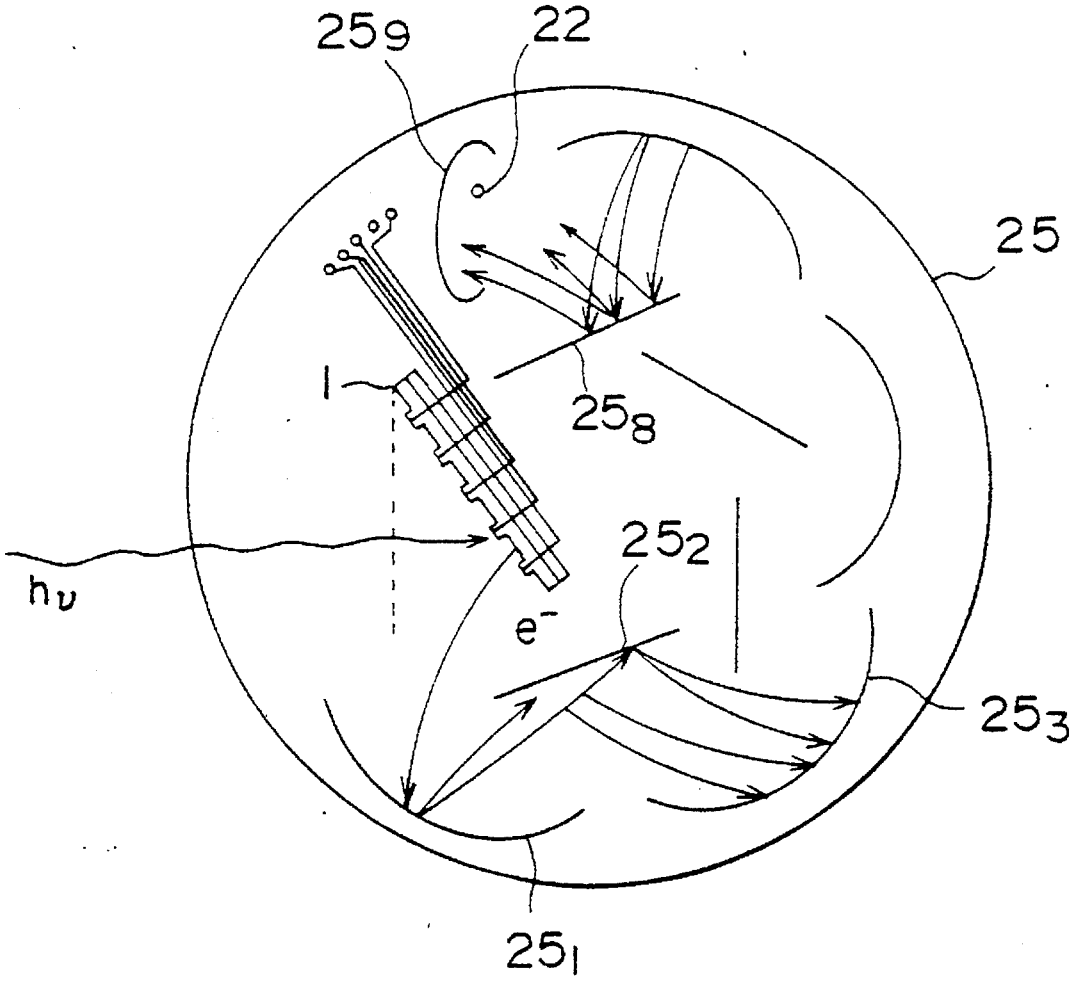
FIG. 13 is a view showing a side-on type photomultiplier using the photocathode according to the embodiment.

Both the application examples in FIGS. 12 and 13 use a transmission photocathode, i.e., a photocathode for emitting photoelectrons in the same direction as the photon incident direction (that is, the photon incident surface is opposite to the photoelectron emission surface). An example shown in FIG. 13 uses a reflection photocathode, i.e., a photocathode for emitting photoelectrons in the direction opposite to the photon incident direction (that is, the photon incident surface also serves as the photoelectron emission surface). This photomultiplier is called a side-on type photomultiplier, and FIG. 13 is a cross-sectional view of its structure. Photons incident from the vacuum vessel 21 formed of, e.g., glass, pass through the focusing electrode (mesh-like electrode) and are incident on the photocathode 1. The emitted photoelectrons are multiplied by the dynodes $\mathbf{25}_1$ to $\mathbf{25}_8$ and incident on the anode 22.

The operation of the photomultipliers in FIGS. 12 to 14 can be explained with reference to the timing chart in FIG. 7. Referring to FIG. 7, "$S_1$ to $S_n$" represent output levels from the shift register to the FET switches. When the output level is at high level, the switch is in an ON state. When the start pulse SP goes to high level, the shift register 5 starts the operation. In accordance with the clock pulse CLK, the FETs are sequentially operated to turn the switches $S_1$ to $S_n$ on. When the switches $S_1$ to $S_n$ are turned on, the pixel electrodes $\mathbf{105}_1$ to $\mathbf{105}_n$ to which a predetermined bias voltage is applied (i.e., the Schottky diodes to which a bias voltage is applied) are operated as electron emission surfaces. As a matter of course, the Schottky electrodes to which no bias voltage is applied are not operated as the photoelectron emission surfaces. Therefore, no photoelectron is emitted regardless of light incident. "$P_1$ to $P_n$" in FIG. 7 represent bias voltages on the photoelectron emission surfaces. When the voltage is at high level, the photoelectron emission surface is in an operative state.

Assume that light is incident on the portion $P_3$ of the photoelectron emission surface of the photomultiplier. In this case, photoelectrons are emitted when a bias voltage is applied to this portion $P_3$. The photoelectrons emitted from the photoelectron emission surface $P_3$ are orbit-corrected by the focusing electrode and incident on the first-stage dynode. The first-stage dynode generates and emits secondary electrons several times the number of the incident primary electrons (photoelectrons). These secondary electrons are multiplied by the second-stage dynode, the third-stage dynode, . . . and finally multiplied by about $\mathbf{10}^6$ and detected as a photocurrent by the anode 22.

The photoelectron emission surfaces $P_1$ to $P_n$ are sequentially operated in accordance with an address signal from the shift register 5, so that the photoelectrons from each photoelectron emission surface are multiplied and detected as a photocurrent. When the clock pulse CLK input to the shift register 5 is synchronized with a signal read by the anode 22, one of the photoelectron emission surfaces $P_1$ to $P_6$ which has emitted the photoelectrons as the anode output $A_{OUT}$ is determined. Therefore, one-dimensional position information of the incident light can be obtained from the timing of the anode output $A_{OUT}$ and the clock pulse CLK.

In this case, the shift register 5 and the photoelectron emission surface are formed on the same substrate to perform the switching and addressing operations of the FETs. However, as in FIG. 11, the bias voltage to the Schottky electrode 105 can be directly controlled from the terminal for each pixel to perform control without using the shift register 5. Unless the wiring is complicated, the shift register 5 can be formed outside the semiconductor substrate constituting the photocathode.

The operation of the photomultiplier in FIG. 12 is the same as that of the above-described photomultiplier in FIG. 11. If light is incident on the portion $P_3$ of the photoelectron emission surfaces, the photoelectron emission surfaces $P_1$ to $P_6$ are sequentially operated in accordance with an address signal from the shift register 5. For this reason, the photoelectrons emitted from the photoelectron emission surface $P_3$ are orbit-corrected by the focusing electrode and incident on the first-stage dynode. The first-stage dynode generates and emits secondary electrons several times the incident primary electrons. These secondary electrons are multiplied by the second-stage dynode, the third-stage dynode, . . . and finally multiplied by about $10^6$ and detected as a photocurrent by the anode 22. Therefore, when the clock pulse CLK input to the shift register 5 is synchronized with a signal read by the anode 22, one of the photoelectron emission surfaces $P_1$ to $P_6$ which has emitted the photoelectrons as the anode output can be determined.

The photocathode can also be applied to a side-on type photomultiplier, and an application example is shown in FIG. 13. A reflection photoelectron emission surface having a one-dimensional position detecting function is provided at a position where light hν is incident. As in the above examples, generated photoelectrons are multiplied by the dynodes $\mathbf{25}_1$ to $\mathbf{25}_8$ and detected by the anode 22. The photoelectron emission direction is different from that of the above-described transmission photoelectron emission surface. However, the operating method is the same as in the head-on type photomultiplier. Position detection by a reflection photoelectron emission surface, which is conventionally impossible, can be performed according to the present invention.

Figure 14:
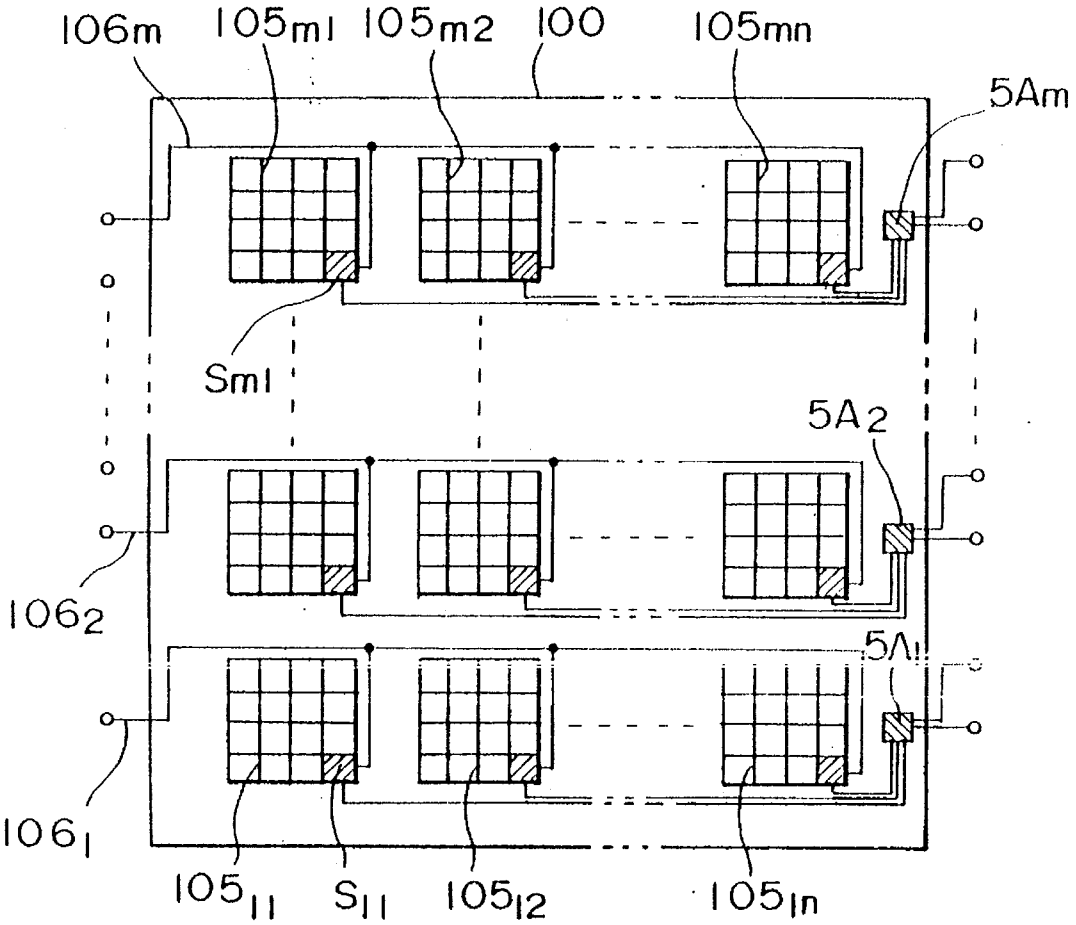
FIG. 14 is a view showing still another embodiment in which pixel electrodes are arranged in a two-dimensional matrix.

FIG. 14 is a view showing a photoelectron emission surface according to still another embodiment of the present invention, in which the photoelectron emission surface is constituted to have a two-dimensional position detecting function. In this embodiment, a plurality (m rows) of photoelectron emission surfaces having the one-dimensional position detecting function as described above are arranged in the longitudinal direction of FIG. 14. Although not included in FIG. 14, a shift register for addressing the photoelectron emission surfaces along the vertical direction is formed externally (on the left side of FIG. 14). More specifically, m shift registers $\mathbf{5A}_1$ to $\mathbf{5A}_m$ are formed on a substrate 100 constituting a photocathode 1 in correspondence with pixel electrodes $\mathbf{105}_{11}$ to $\mathbf{105}_{1n}$, $\mathbf{105}_{21}$ to $\mathbf{105}_{2n}$, . . . , $\mathbf{105}_{m1}$ to $\mathbf{105}_{mn}$. The shift registers externally provided are connected to m rows of bias application wires $\mathbf{106}_1$ to $\mathbf{106}_m$ through terminal pins, respectively. The first shift registers $\mathbf{5A}_1$ to $\mathbf{5A}_m$ externally input a clock pulse CLK and a start pulse SP through the terminal pins, and have n output terminals in correspondence with the pixel electrodes. A second shift register which is externally provided also inputs the clock pulse CLK and the start pulse SP. The photocathode arranged in a two-dimensional matrix of m rows×n columns of pixel electrodes is realized by an output from the second shift register.

Figure 15:
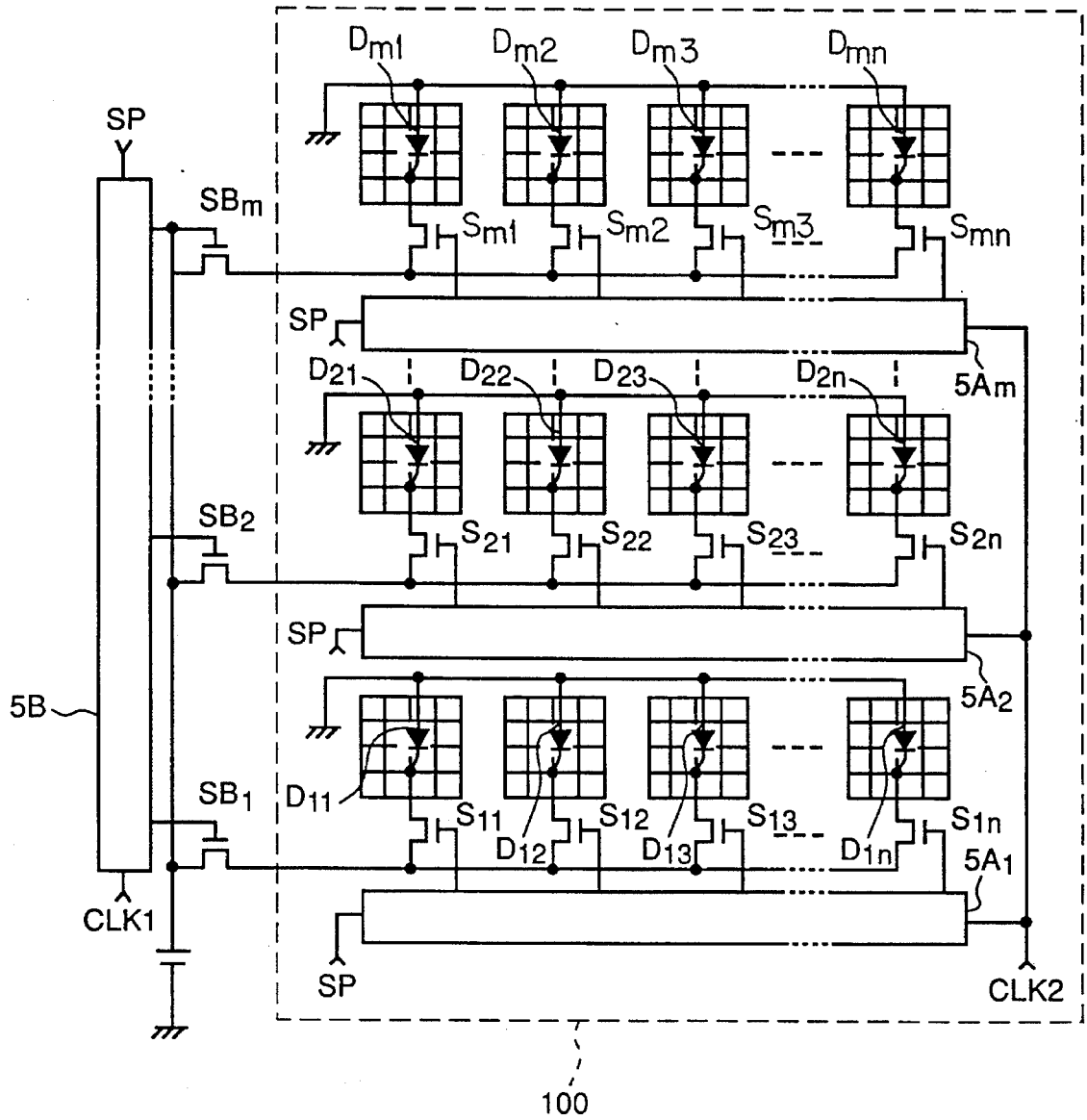
FIG. 15 is a view showing the embodiment, in which the pixel electrodes are arranged in the two-dimensional matrix.

FIG. 15 is a view showing an equivalent circuit when the photoelectron emission surface having m×n pixel structure is operated, in which a portion enclosed by a dotted line represents the circuit formed on the substrate in FIG. 14. The first registers $\mathbf{5A}_1$ to $\mathbf{5A}_m$ in the horizontal direction have the same circuit arrangement as in FIG. 2. The first registers are simultaneously operated in parallel in accordance with the start pulse SP and the clock pulse $CLK_2$ to sequentially turn switches $S_{11}$ to $S_{mn}$ on. Switches $SB_1$ to $SB_m$ are connected to the output terminals of the second shift register 5B in the longitudinal direction, addressed by the shift register 5B in accordance with a clock pulse $CLK_1$, and sequentially turned on. The switches $S_{11}$ to $S_{mn}$ provided to the output terminals of the shift registers $\mathbf{5A}_1$ to $\mathbf{5A}_m$ are connected in series to the switches $SB_1$ to $SB_m$ with respect to a bias power supply $+V_B$. When both the switches connected in series to the power supply are turned on, the bias voltage $+V_B$ is externally applied to Schottky diodes $D_{11}$ to $D_{mn}$.

Figure 16:
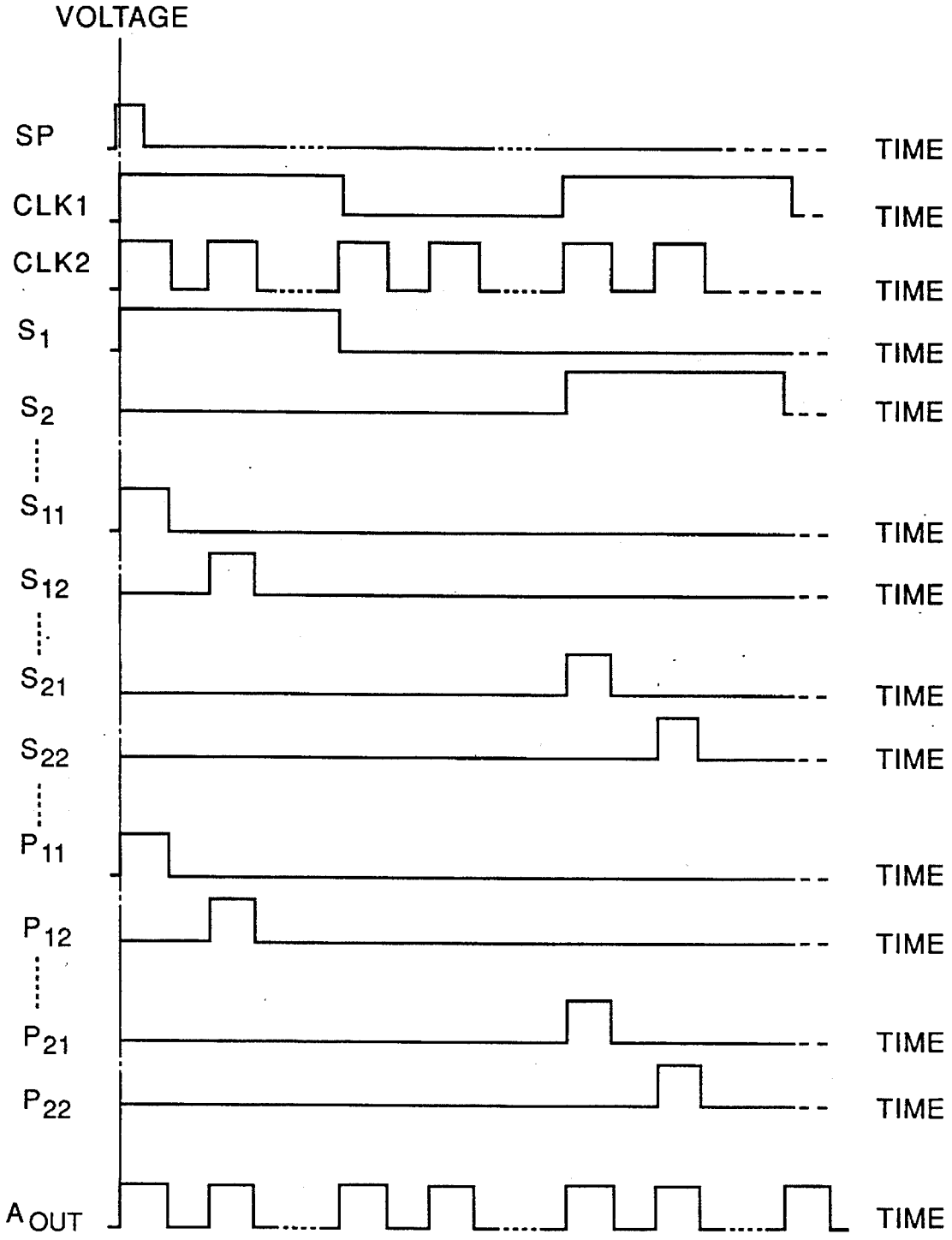
FIG. 16 is a timing chart showing the operation of the embodiment in FIG. 14, in which the pixel electrodes are arranged in the two-dimensional matrix.

A photomultiplier having a two-dimensional position detecting function can be constituted by using the photoelectron emission surface in FIGS. 15 and 16, as in the photomultiplier having the one-dimensional position detecting function. FIG. 16 is a timing chart of the operation of this photomultiplier. "S" in FIG. 16 represents an output level from the shift register to the FET switch. When the output level is at high level, the switch is in an ON state.

When the start pulse SP goes to high level, all the shift registers simultaneously start the operation. When the clock pulse $CLK_1$ is input, the shift register 5B sequentially turns the FETs on in the longitudinal direction. First of all, the switch $SB_1$ is addressed and turned on. In accordance with a clock pulse $CLK_2$, the shift registers in the horizontal direction is also simultaneously operated in parallel. If all the outputs from these shift registers are at high level, the bias voltage $+V_B$ is applied to cause photoelectron emission surfaces $P_{11}$ to $P_{mn}$ to emit photoelectrons. In the timing chart in FIG. 16, when the switch $S_{11}$ is in the ON state, the switches $S_{21}$ to $S_{2m}$ in the longitudinal direction are also in the ON state. However, if the switch $SB_1$ is in the ON state, the bias voltage $+V_B$ is applied to only the photoelectron emission surface $P_{11}$ and the photoelectron emission surface $P_{11}$ is operated. When the switch $SB_1$ is in the ON state, the switches of the switches $S_{11}$ to $S_{mn}$ in the longitudinal direction are sequentially turned on to sequentially operate the photoelectron emission surfaces $P_{11}$ to $P_{1n}$. This operation is also sequentially performed for the switches $SB_2$ to $SB_m$.

When the clock pulse $CLK_1$ is synchronized with the clock pulse $CLK_2$ from shift registers $A_{11}$ to $A_{mn}$, and the width of the clock pulse $CLK_1$ is set to n times the period of the clock pulse $CLK_2$, the switches are turned on to sequentially apply the bias voltage $+V_B$ to the Schottky diodes $P_{11}$ to $P_{mn}$ from the upper left portion to the lower right portion in FIG. 15. Photoelectrons generated by excitation of the incident light are sequentially emitted from the photoelectron emission surfaces $P_{11}$ to $P_{mn}$ from the upper left portion to the lower right portion in FIG. 15, multiplied, and detected.

As in the above embodiment, when the clock pulses $CLK_1$ and $CLK_2$ are synchronized with a read signal, two-dimensional position information of the incident light can be obtained. Therefore, when the clock pulses $CLK_1$ and $CLK_2$ are synchronized with the anode output, two-dimensional position detection can be performed. As a matter of course, as described above, the shift registers or the switching FETs may be formed on the substrate where the photoelectron emission surfaces are formed, or may be formed on a remaining portion.

Figure 17:
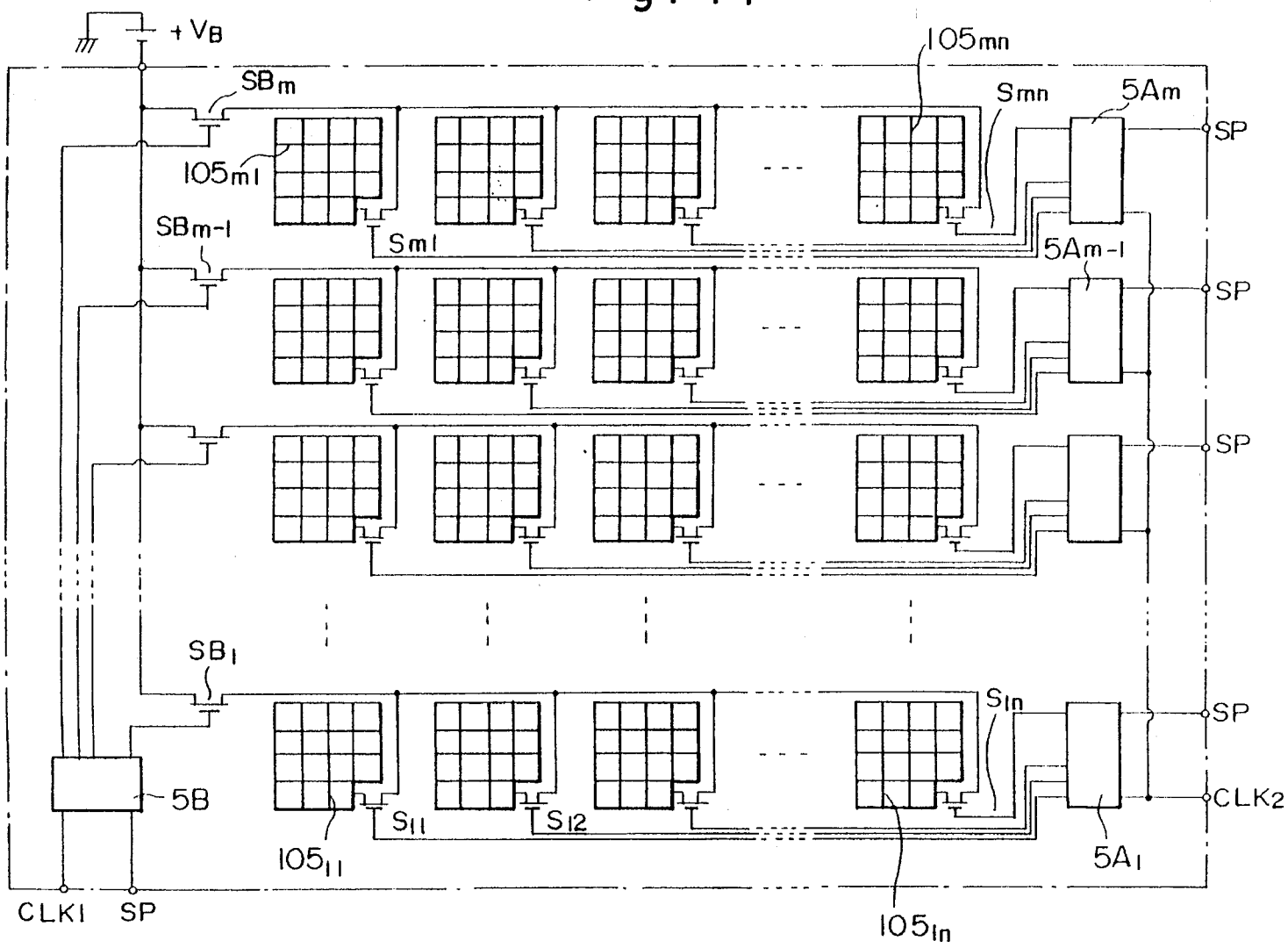
FIG. 17 is a view showing yet another embodiment in which pixel electrodes are arranged in a two-dimensional matrix.

As shown in FIG. 17, all of first and second shift registers may be formed on a substrate 100 constituting the photocathode. With this arrangement, since the number of terminal pins of the substrate 100 can be largely reduced, a multi-pixel structure can be realized to improve the position resolution. Note that the same reference numerals or symbols as in FIGS. 15 and 16 denote the same elements in FIG. 17.

Figure 18:
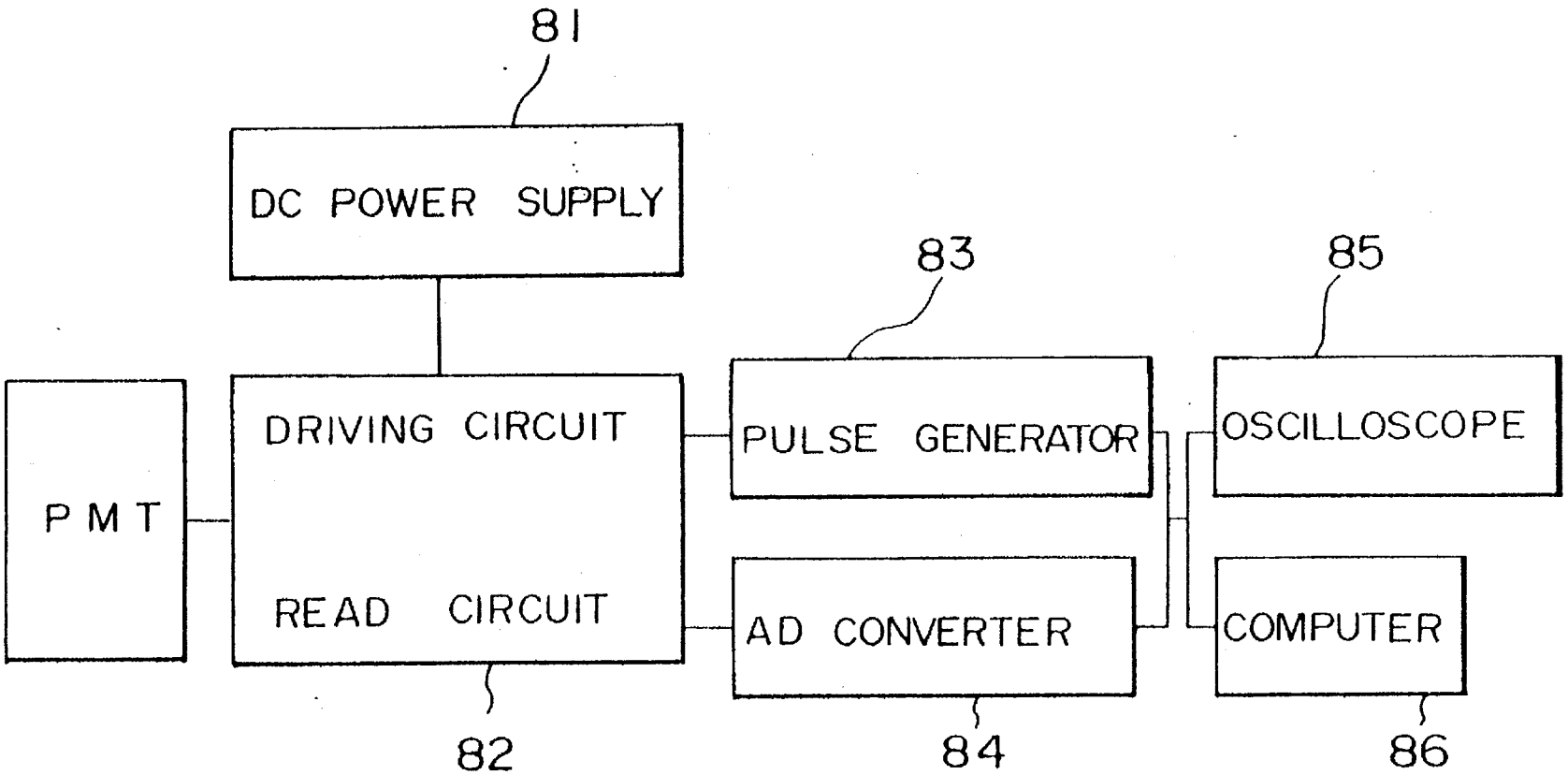
FIG. 18 is a block diagram showing a photodetector according to the above embodiments.

FIG. 18 is a view showing an arrangement system of an optical position detecting apparatus using the photomultiplier according to the present invention. This system includes a photomultiplier PMT, a driving circuit for driving the photomultiplier PMT and a read circuit unit 82 for reading a signal, a DC power supply unit 81 for applying a high voltage to the photomultiplier PMT, a pulse generator 83 for generating an input clock pulse (e.g., CLK, $CLK_1$, or $CLK_2$) to the photomultiplier PMT, an A–D converting unit 84 for converting a read signal from the photomultiplier PMT, an oscilloscope (display unit such as a CRT or LCD) 85, and a control computer unit 86. Except for the photomultiplier PMT, all the elements are components conventionally used. As described above, when the generation timing of an input clock pulse to the photomultiplier PMT is controlled by the computer 86, and a read signal is received from the photomultiplier PMT, position information of light incident on the photomultiplier PMT can be easily obtained. This information can also be converted into image data to be displayed by the display unit.

As described above, although the photoelectron emission surface of the present invention is formed on one substrate, when a bias voltage is individually applied to a plurality of pixel electrodes, a plurality of photoelectron emission surfaces can be separately operated. For this reason, a photodetector having a structure much simpler than that of a conventional photodetector having a photoelectron emission surface can be provided to perform position detection with minimum crosstalk.

with the photoelectron emission surface of the present invention, secondary-electron multiplication of photoelectrons allows noise-free photodetection with an ultrahigh sensitivity. For this reason, position detection under weak light or detection of image information can be easily performed. In addition, since a portion to which no bias voltage is applied does not emit electrons which are generated by a dark current, no noise is generated from the portion which does not operate as a photoelectron emission surface, and a substantially noise-free photodetector can be realized. Therefore, the photodetector using the photoelectron emission surface of the present invention, and a photodetecting apparatus using this photodetector allow noise-free position detection with an ultrahigh sensitivity.

The conventional photoelectron emission surface having a position detecting function of this type must have a so-called transmission structure in which the light incident direction is different from the photoelectron emission direction. However, according to the present invention, also a so-called reflection structure in which the light incident direction and the photoelectron emission direction are the same can have the position detecting function, thereby largely increasing the degree of freedom of a device, structure, or design.

In the present invention, photoelectrons emitted from the entire photoelectron emission surface for performing photoelectric conversion of incident light are not selectively multiplied, and part of the photoelectron emission surface is operated upon application of a bias voltage. For this reason, an electron emission surface having a noise-free position detecting function with minimum crosstalk can be easily obtained. By adding a multiplication unit to form a photomultiplier unit, a photodetector having the position detecting function with a higher sensitivity can be realized.

The present invention is not limited to the above embodiments, and various modifications can be made.

For example, although the photoelectron emission surface using InP or InGaAsP as the main material has been exemplified, the material is not limited to this, as a matter of course. In addition, the Schottky electrode, the ohmic electrode, and the alkali metal are not limited to those used in the above embodiments. Furthermore, when an address decoder is used in place of the shift register to add an input address pulse, position detection which allows random access can be performed.

U.S. Pat. No. 3,958,143 discloses an example of a photoelectron emission surface in which photoelectrons are accelerated by an internal field and emitted into a vacuum. However, the photoelectron emission surface described in this prior art cannot obtain position information. Japanese Patent Laid-Open No. 4-269419 discloses a photoelectron emission surface having a Schottky electrode formed in a pattern. This photoelectron emission surface does not form a plurality of electrodes or individually apply a bias voltage, either, and no position information can be obtained.

As has been described above, according to a photomultiplier of the present invention, a detection output according to a light incident position on a photoelectric surface can be obtained, thereby realizing a compact photomultiplier. The photomultiplier can be constituted using a photoelectron emission surface of the present invention. In addition, in the photodetecting apparatus using the photomultiplier of the present invention, even when light incident on the photoelectric surface is very weak, one- or two-dimensional information carried by the incident light can be obtained.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

What is claimed is:

1. A photocathode for emitting electrons in response to light input thereto, said photocathode comprising:

a semiconductor layer having a first surface and a second surface facing said first surface, wherein the light is incident on said second surface and the electrons are emitted from said first surface;

a first pixel electrode, being a single unitary solid member and having a plurality of openings therein, said first pixel electrode being in contact with said first surface of said semiconductor layer;

a first wire electrically connected to said first pixel electrode;

a second pixel electrode, also being a single unitary solid member, having a plurality of openings therein, said second pixel electrode being in contact with said first surface of said semiconductor layer, said second pixel electrode being physically isolated from said first pixel electrode;

a second wire electrically connected to said second pixel electrode; and a second surface electrode contacting said second surface of said semiconductor.

2. A photocathode according to claim 1, wherein said semiconductor layer has a heterojunction structure.

3. A photocathode according to claim 2, wherein said semiconductor layer has a heterojunction structure formed of a material selected from the group consisting of GaAs, AlAs and a mixed crystal thereof.

4. A photocathode according to claim 2, wherein said semiconductor layer has a heterojunction structure formed of a material selected from the group consisting of InP, GaAs, and a mixed crystal thereof.

5. A photocathode according to claim 2, wherein said semiconductor layer has a heterojunction structure formed of a material selected from the group consisting of Si, Ge, and a mixed crystal thereof.

6. A photocathode according to claim 1, wherein a material selected from the group consisting of an alkali metal, an alkali metal compound, an oxide of said alkali metal compound, and a fluoride of said alkali metal compound is coated on said first surface of said semiconductor layer.

7. A photocathode according to claim 6, wherein said alkali metal is a material selected from the group consisting of Cs, K, Na, and Rb.

8. A photocathode according to claim 1, wherein said first and second pixel electrodes are in Schottky contact with said semiconductor layer.

9. A photocathode according to claim 1, wherein said first and second pixel electrodes are disposed in a one-dimensional array.

10. A photocathode according to claim 1, further comprising:

a third pixel electrode having a plurality of openings therein and being in contact with said first surface of said semiconductor layer;

a third wire electrically connected to said third pixel electrode;

a fourth pixel electrode having a plurality of openings therein and being in contact with said first surface of said semiconductor layer; and a fourth wire electrically connected to said fourth pixel electrode, wherein said first, second, third and fourth pixel electrodes are physically isolated from each other, and are disposed in a two-dimensional matrix.

11. A photocathode according to claim 1, wherein the electrons generated in said semiconductor layer in response to the light input thereto accelerate in said semiconductor layer.

12. A photocathode according to claim 1, wherein said first and second pixel electrodes are formed of a material selected from the group consisting of Al, Au, Ag, W, Ti, WSi, and alloys thereof.

13. A photocathode according to claim 1, wherein the electrons accelerate in said semiconductor layer and then pass through said openings of said first and second pixel electrodes.

14. A photocathode according to claim 1, wherein an interval between said openings of said first pixel electrode is not more than 10 μm.

15. A photocathode according to claim 1, wherein said second surface electrode and said semiconductor layer are in ohmic contact with each other.

16. A photocathode according to claim 1, wherein said second surface electrode is a transparent electrode consisting of a material with light transmissive properties.

17. A photocathode according to claim 1, wherein said second surface electrode has a thickness that allows light to pass therethrough.

18. A photocathode according to claim 1, wherein said second surface electrode is a metal electrode having a plurality of openings for admitting light.

19. A photocathode according to claim 1, wherein said semiconductor layer comprises:

a semiconductor substrate contacting said second surface electrode;

a p-type light absorption layer for converting the light into the electrons, said p-type absorption layer contacting said semiconductor substrate; and a p-type contact layer disposed between said p-type light absorption layer and said first and second pixel electrodes, said p-type contact layer being in Schottky contact with said first and second pixel electrodes.

20. A photocathode according to claim 1, further comprising a switching element for alternatively electrically connecting said second surface electrode to one of said first and second wires, said switching element being formed on said first surface of said semiconductor layer.

21. A photocathode according to claim 20, wherein said switching element includes a FET having a gate, and wherein said photocathode further comprises a shift register connected to said gate of said switching element, wherein a predetermined potential is applied to the gate so that electrons are emitted from said photocathode.

22. A photocathode according to claim 10, wherein said two-dimensional matrix includes m rows by n columns, and wherein said photocathode further comprises:

a first FET for electrically connecting said second surface electrode to said first wire, said first FET including a gate;

a second FET for electrically connecting said second surface electrode to said second wire, said second FET including a gate;

a first shift register electrically connected to said gates of said first and second FETs;

a third FET for electrically connecting said second surface electrode to said third wire, said third FET including a gate;

a fourth FET for electrically connecting said second surface electrode to said fourth wire, said fourth FET including a gate; and a second shift register electrically connected to said gates of said third and fourth FETs.

23. A phototube comprising:

a vacuum vessel;

a photocathode for emitting electrons in response to light input thereto, said photocathode being disposed in said vacuum vessel, wherein said photocathode comprises:

a semiconductor layer having a first surface and a second surface facing said first surface, wherein the light is incident on said second surface and the electrons are emitted from said first surface, a first pixel electrode being a single solid unitary member and having a plurality of openings therein, said first pixel electrode contacting said first surface of said semiconductor layer, a first wire electrically connected to said first pixel electrode, a second pixel electrode being a single solid unitary member and having a plurality of openings therein, said second pixel electrode being in contact with said first surface of said semiconductor layer, wherein said first pixel electrode and said second pixel electrode are physically isolated from each other, a second wire electrically connected to said second pixel electrode, and a second surface electrode being in contact with said second surface of said semiconductor laser, wherein said second surface electrode is alternatively electrically connected to one of said first and second wires; and an anode for receiving the electrons emitted from said photocathode, said anode being disposed in said vacuum vessel.

24. A phototube according to claim 23, wherein said semiconductor layer comprises:

a semiconductor substrate contacting said second surface electrode;

a p-type light absorption layer for converting the light into the electrons, said p-type light absorption layer contacting said semiconductor substrate; and a p-type contact layer disposed between said p-type light absorption layer and said first and second pixel electrodes, said p-type contact layer being in Schottky contact with said first and second pixel electrodes; and wherein a switching control means alternatively electrically connects said second surface electrode to one of said first and second pixel electrodes.

25. A phototube according to claim 23, further comprising electron multiplying means for multiplying the electrons emitted from said photocathode, said electron multiplying means being disposed in said vacuum vessel.

26. A photodetecting apparatus comprising:

a vacuum vessel;

a photocathode for emitting electrons in response to light included thereon, said photocathode being disposed in said vacuum vessel, wherein said photocathode comprises:

a semiconductor layer having a first surface and a second surface facing said first surface, wherein the light is incident on said second surface and the electrons are emitted from said first surface, a first pixel electrode being a single unitary solid member and having a plurality of openings therein, said first pixel electrode contacting said first surface of said semiconductor layer, a first wire electrically connected to said first pixel electrode, a second pixel electrode being a single unitary solid member and having a plurality of openings therein, said second pixel electrode contacting said first surface of said semiconductor layer, wherein said first pixel electrode and said second pixel electrode are physically isolated from each other, a second wire electrically connected to said second pixel electrode, and a second surface electrode contacting said second surface of said semiconductor; and an anode for receiving the electrons emitted from said photocathode, said anode being disposed in said vacuum vessel;

a switching element for alternatively electrically connecting said second surface electrode to one of said first and second wires;

a switching circuit for sequentially switching ON/OFF states of said switching element in response to a timing pulse;

timing control means for continuously applying said timing pulse to said switching circuit in response to a start signal; and memory means for beginning to store output from said anode, which collects the electrons emitted from the photocathode, in response to said start signal.

* * * * *